US007194212B2

(12) United States Patent
Kumai et al.

(10) Patent No.: US 7,194,212 B2
(45) Date of Patent: Mar. 20, 2007

(54) IMAGE FORMING APPARATUS ATTACHED WITH REPLACEABLE UNIT

(75) Inventors: Hiroaki Kumai, Saitama (JP); Kiyoshi Nagamine, Saitama (JP); Hideaki Tanaka, Saitama (JP); Hiroh Soga, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 311 days.

(21) Appl. No.: 11/024,760

(22) Filed: Dec. 30, 2004

(65) Prior Publication Data

US 2005/0254832 A1 Nov. 17, 2005

(30) Foreign Application Priority Data

May 17, 2004 (JP) ..... P.2004-146140

(51) Int. Cl.
*G03G 15/00* (2006.01)

(52) U.S. Cl. ..... 399/12; 399/27

(58) Field of Classification Search ..... 399/12, 399/27

See application file for complete search history.

(56) References Cited

U.S. PATENT DOCUMENTS 6,990,297 B2 * 1/2006 Ito et al. ..... 399/27

FOREIGN PATENT DOCUMENTS

| | | |
|---|---|---|
| JP | 02-081056 | 3/1990 |
| JP | A 06-149051 | 5/1994 |
| JP | B2 2602341 | 1/1997 |
| JP | A 10-133528 | 5/1998 |
| JP | A-2000-284581 | 10/2000 |
| JP | 2001-100598 | 4/2001 |
| JP | B2 3476704 | 9/2003 |
| KR | 2001-67327 | 7/2001 |

* cited by examiner

*Primary Examiner*—Susan Lee
(74) *Attorney, Agent, or Firm*—Oliff & Berridge, PLC

(57) ABSTRACT

By using information stored in a storage part provided in the image forming apparatus main body or the results of detection of an image density sensor or the like, it is judged whether or not a replaceable unit such as a toner cartridge has been replaced. Furthermore, from information stored in the storage part provided in the image forming apparatus main body, it is detected whether a replaceable unit such as a toner cartridge is genuine or other than genuine units. From these detection results, information on the amount used for developer of the replaced toner cartridge, stored in the storage part, is initialized.

16 Claims, 30 Drawing Sheets

(FIG. 19 CONTINUED)
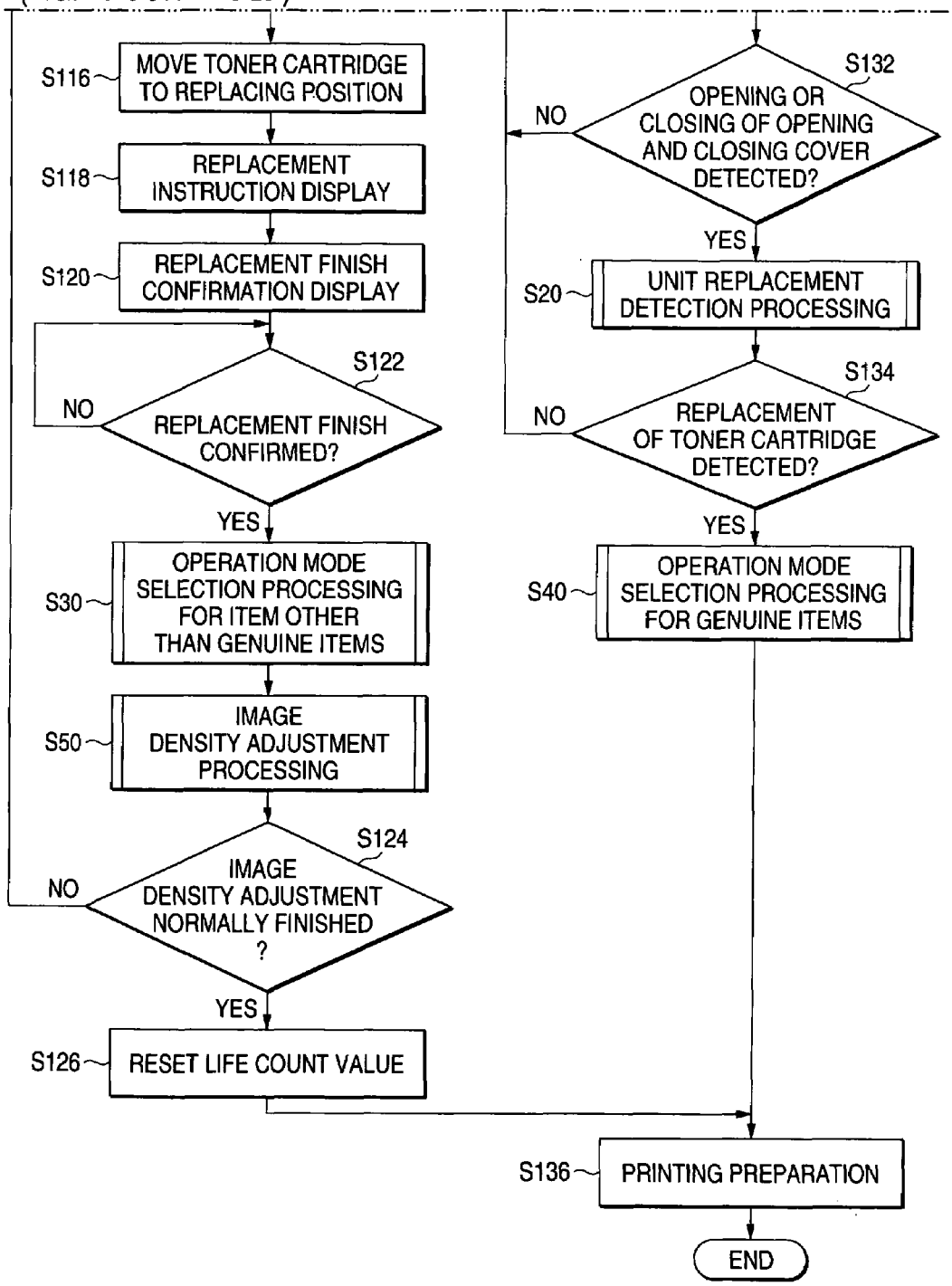

(FIG. 26 CONTINUED)
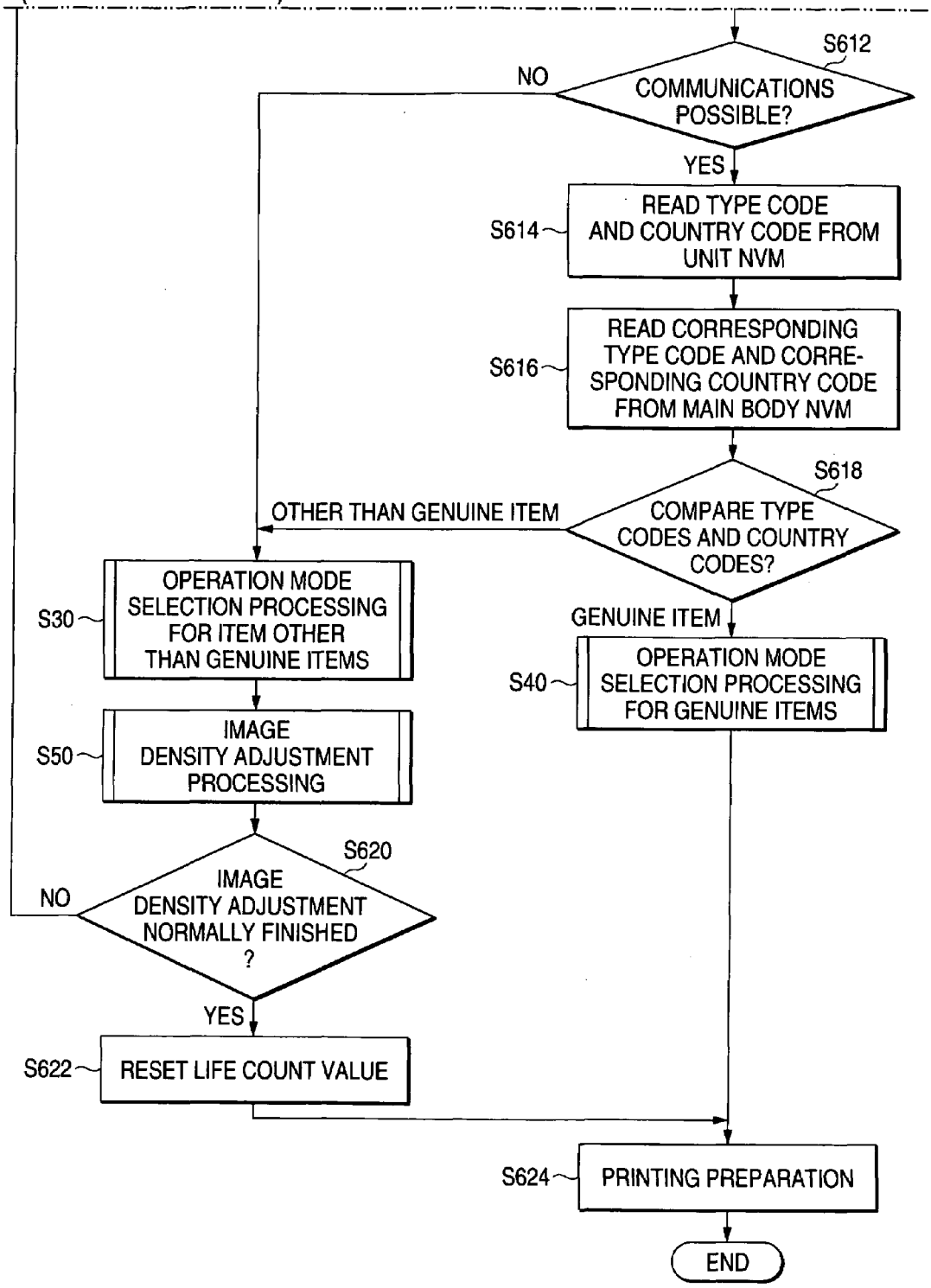

IMAGE FORMING APPARATUS ATTACHED WITH REPLACEABLE UNIT

BACKGROUND OF THE INVENTION

1. Field of the Invention

The invention relates to an image forming apparatus, and more specifically, an image forming apparatus including a replaceable unit attached in a replaceable manner to the apparatus main body.

2. Background Art

As an image forming apparatus, there is known one having a unit including a consumable article being able to be replaced readily by a user.

On the other hand, when a unit replaced by a user is other than genuine units of the image forming apparatus, the image forming apparatus may not fully show its performance due to lowering in image quality, etc., its operation cannot be guaranteed, or a problem such as a malfunction may occur. The reason for this is that the image forming apparatus controls the image forming process on the basis of the properties of toner, the characteristics of the image carrier, charging voltage, cleaning performance, and fixing performance, etc.

Therefore, in order to maintain the image quality of the image forming apparatus and prevent problems, in JP-A-10-133528, a method for judging whether or not a consumable article has been replaced for a genuine replaceable part by comparing a consumption amount detected by a consumption amount detection part provided inside the apparatus main body and consumption amount data held by a data carrier by providing the genuine replaceable part with the data carrier for holding a consumption amount of a consumable article.

Furthermore, JP-A-6-149051 discloses that a storage unit for storing predetermined code data is provided for a toner cartridge, and when a copying machine main body side cannot read the predetermined code data from the storage unit, copying is prohibited.

In addition, in JP-A-2001-100598, a method is disclosed in which when empty information written in a cartridge is readout from the toner filled cartridge in a case where toner exhaustion has been detected, a warning is indicated and printing is prohibited.

Furthermore, in Japanese Patent No. 2602341, a method is disclosed in which a count of created images is stored in a memory of a cartridge, and when a preset finish count indicating the number of images creatable by the cartridge is equal to a count of created images, the cartridge is made unusable thereafter.

Furthermore, in Japanese Patent No. 3476704, a method is disclosed in which, by bidirectional communications between a container side communications unit of a toner supply container and a main body side communications unit of an apparatus main body, when it is judged that the attached toner supply container is nonconforming, and it is selected by a select input unit that supply processing is to be continued by ignoring the judgment as nonconforming, image forming conditions on a level lower than the level of proper image forming conditions are set so that it can be found readily that the toner supply container is nonconforming.

Furthermore, in JP-A-2-81056, a method is disclosed in which information corresponding to a consumption degree of a consumable article is written in an involatile memory provided in the consumable article and the life management of the consumable article is performed.

SUMMARY OF THE INVENTION

A first object of the invention is to provide an image forming apparatus which, even when a replaceable unit that is a unit other than genuine units is attached, can use the replaceable unit which is a unit other than genuine units according to the user's intent. A second object of the invention is to provide an image forming apparatus which can make controlling on the basis of information on an amount used for a replaceable unit even when the replaceable unit has no storage unit for storing information on the amount used for a replaceable unit.

In order to achieve the above-mentioned objects, an image forming apparatus of the invention includes: an apparatus main body; at least one replaceable unit attached in a replaceable manner to this apparatus main body; a storage unit which is provided in the apparatus main body and stores information on an amount used for a replaceable unit; a control unit for controlling on the basis of the information on the amount used for the replaceable unit stored in the storage unit; a first judging unit for judging whether the replaceable unit is genuine or other than genuine units; a second judging unit for judging whether or not the replaceable unit has been replaced; and an initialization unit for initializing the information on the amount used for the replaceable unit stored in the storage unit when it is judged that the replaceable unit has been replaced with one other than genuine units from the results of judgment of the first judging unit and the second judging unit. Therefore, the image forming apparatus is controlled on the basis of information on an initialized amount used for the replaceable unit even when the replaceable unit is replaced with one other than genuine units, so that the replaceable unit other than genuine units can be used according to the user's intent.

Herein, the operation mode means the controlling manner of the image forming apparatus, and includes not only a program and control parameters for image formation but also input conditions and output conditions, and further includes a display manner on a display apparatus that does not directly concern image formation.

Preferably, the image forming apparatus of the invention further includes: a communications unit which is provided on the apparatus main body side and makes communications so as to acquire information from the replaceable unit, wherein the first judging unit judges whether the replaceable unit is genuine or other than genuine units from the results of communications of the communication unit. Namely, even when the replaceable unit is replaced, it can be judged whether or not the replaceable unit is genuine.

Furthermore, preferably, the first judging unit judges the replaceable unit as being other than genuine units when no information can be acquired from the replaceable unit as a result of communications of the communications unit. Namely, even when the apparatus main body side cannot communicate with the replaceable unit, it can be judged whether or not the replaceable unit is genuine.

Furthermore, preferably, the image forming apparatus of the invention further includes: a display unit for displaying information on an amount used for a replaceable unit, wherein the control unit controls the display unit. Therefore, the user can obtain information on the amount used for a replaceable unit, so that a replaceable unit other than genuine units can be used according to the user's intent.

Furthermore, preferably, the control unit performs controlling so as to correct image forming conditions according to the amount used for a replaceable unit. Namely, when it is judged that the replaceable unit has been replaced with one other than genuine units, image forming conditions are corrected according to the amount used for a replaceable unit, so that the replaceable unit other than genuine units can be used according to the user's intent.

Furthermore, preferably, the second judging unit judges whether or not the replaceable unit has been replaced from information on a replacement operation for the replaceable unit. Namely, it is judged whether or not the replaceable unit has been replaced according to the replacement operation of the replaceable unit, so that it is not necessary to provide a judging unit only for judging whether or not the replaceable unit has been replaced, and the arrangement of the image forming apparatus can be prevented from becoming complicated. For example, the image forming apparatus of the invention further includes: an image carrier for carrying a developer image; and an image density change detection unit for detecting a change in density of a developer image carried by this image carrier, wherein the second judging unit judges whether or not the replaceable unit has been replaced on the basis of the results of detection of the image density change detection unit.

Preferably, the image forming apparatus of the invention further includes: an image carrier for carrying an image by carrying a developer; and a developer amount detection unit for detecting information on an amount used for a developer carried by the image carrier, wherein the second judging unit judges whether or not the replaceable unit has been replaced on the basis of the results of detection of the developer amount detection unit.

Furthermore, preferably, the image forming apparatus of the invention further includes: a use history judging unit for judging use history of the replaceable unit, wherein the second judging unit judges whether or not the replaceable unit has been replaced on the basis of the results of judgment of the use history judging unit.

Furthermore, preferably, the image forming apparatus of the invention further includes: an image carrier for carrying an electrostatic latent image and a developer image; a developer collecting unit for collecting a developer remaining on the image carrier after the image carrier transfers the developer image; and a collected developer amount detection unit for detecting the amount of the developer collected by this developer collecting unit, wherein the second judging unit judges whether or not the replaceable unit has been replaced on the basis of the results of detection of the collected developer amount detection unit.

Furthermore, preferably, the image forming apparatus of the invention further includes: a developing unit for developing an electrostatic latent image carried by the image carrier; and a transfer unit for transferring the developer image carried by the image carrier, wherein the replaceable unit is formed integrally with at least any of the image carrier, the developer collecting unit, the developing unit, and the transfer unit. Therefore, for each unit formed integrally as a replaceable unit, it can be judged whether or not the replaceable unit is genuine and whether or not the replaceable unit has been replaced, and the arrangement of the image forming apparatus is prevented from becoming complicated.

Furthermore, preferably, the image forming apparatus of the invention further includes: an image carrier for carrying an electrostatic latent image and a developer image; an intermediate transfer body for carrying a developer image transferred from the image carrier; an intermediate transfer body developer collecting unit for collecting a developer remaining on the intermediate transfer body after the intermediate transfer body transfers a developer image; and an intermediate transfer body collected developer amount detection unit for detecting an amount of developer collected by the intermediate transfer body developer collecting unit, wherein the second judging unit judges whether or not the replaceable unit has been replaced on the basis of the results of detection of the intermediate transfer body collected developer amount detection unit.

Furthermore, preferably, the image forming apparatus of the invention further includes: a developing unit for developing an electrostatic latent image carried by the image carrier; a first transfer unit for transferring a developer image carried by the image carrier onto the intermediate transfer body; a developer collecting unit for collecting a developer remaining on the image carrier after transferring the developer image carried by the image carrier; and a second transfer unit for transferring the developer image carried by the intermediate transfer body, wherein the replaceable unit is formed integrally with at least any of the image carrier, the developing unit, the first transfer unit, the developer collecting unit, the intermediate transfer body, the second transfer unit, and the intermediate transfer body developer collecting unit. Therefore, for each unit formed integrally as a replaceable unit, it can be judged whether or not the replaceable unit is genuine and whether or not the replaceable unit has been replaced, and the arrangement of the image forming apparatus is prevented from becoming complicated.

Preferably, the display unit displays information on the amount used for the replaceable unit on the basis of information on the amount used for the replaceable unit initialized by the initialization unit. Therefore, a user can obtain information on an initialized amount used for the replaceable unit and can use the replaceable unit other than genuine units according to the user's intent.

Preferably, the control unit corrects image forming conditions on the basis of information on the amount used for the replaceable unit initialized by the initialization unit. Namely, when it is judged that the replaceable unit has been replaced with one other than genuine units, image forming conditions are corrected according to an initialized amount used for a replaceable unit, so that the replaceable unit other than genuine units can be used according to the user's intent.

Preferably, the image forming apparatus of the invention further includes: a judging result display unit for displaying the results of judgment of the first judging unit and the second judging unit when it is judged that the replaceable unit has been replaced with a unit other than genuine units from the results of judgment of the first judging unit and the second judging unit; and an input unit for selecting an operation mode corresponding to a genuine replaceable unit and another operation mode different from said operation mode, wherein the input unit receives an input for selecting the operation mode corresponding to a genuine replaceable unit and another mode different from said operation mode after the judging result display unit displays the results of judgment. Namely, a user can select an operation mode corresponding to a genuine replaceable unit or another operation mode, and can use a replaceable unit other than genuine units according to the user's intent.

According to the invention, even when a replaceable unit other than genuine units is attached, the replaceable unit other than genuine units can be used according to the user's intent. Furthermore, according to the invention, even when a storage unit for storing information on the amount used for the replaceable unit is not provided in the replaceable unit, controlling can be made on the basis of information on the amount used for a replaceable unit.

BRIEF DESCRIPTION OF THE DRAWINGS

These and other objects and advantages of this invention will become more fully apparent from the following detailed description taken with the accompanying drawings in which:

FIGS. 18A and 18B are graphs showing the results of correction by the settings of FIG. 17, wherein FIG. 18A shows the corrected toner density, and FIG. 18B shows the corrected image density.

FIGS. 25A and 25B are drawings illustrating screens to be displayed on the UI device, wherein FIG. 25A is a screen for accepting an input made by a user for selection of an operation mode for a genuine item, and FIG. 25B is a screen for accepting an input made by a user for selection of an operation mode for an item other than genuine items.

DETAILED DESCRIPTION OF THE PREFERRED EMBODIMENTS

Next, an embodiment of the invention is described.

Figure 1:
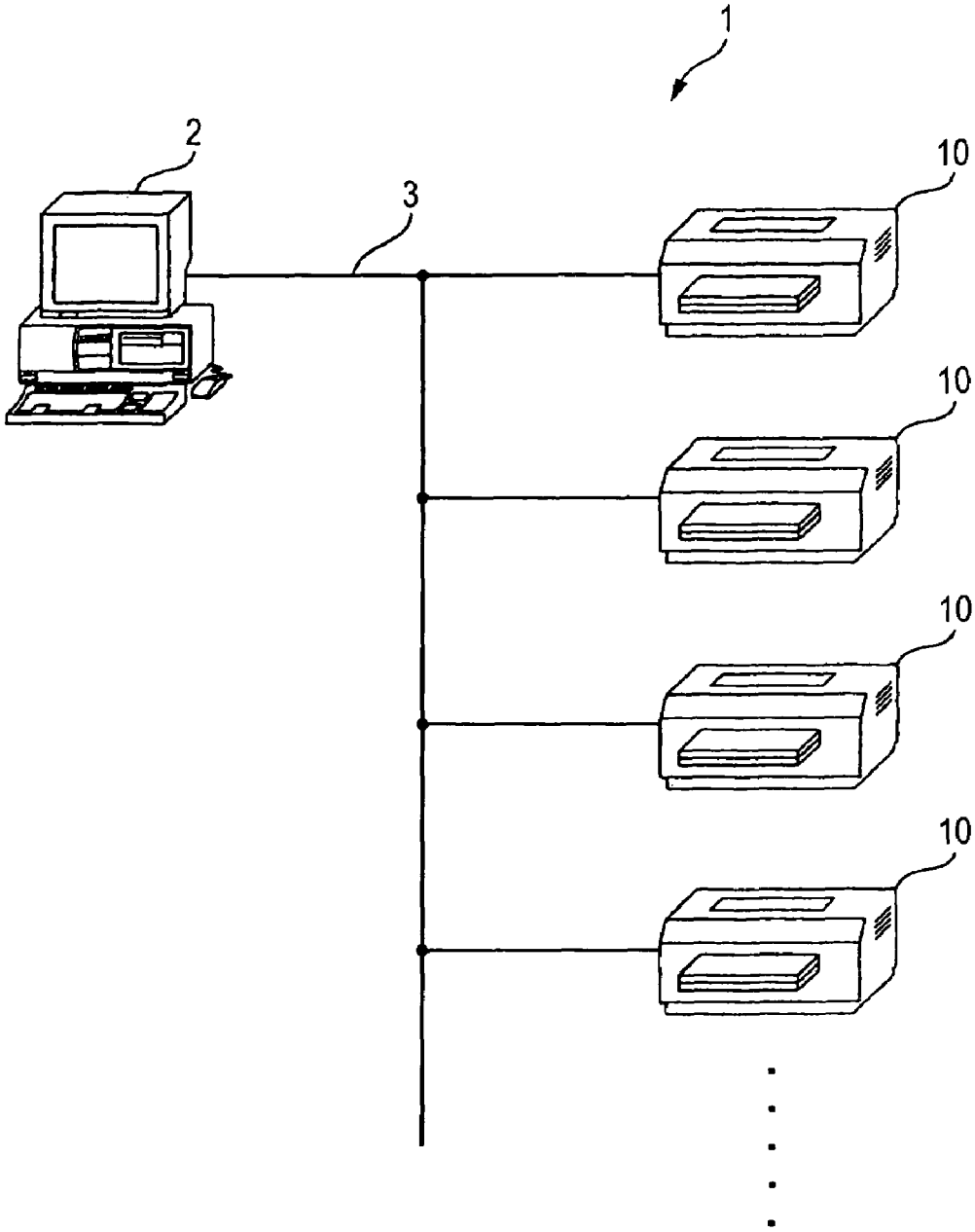
FIG. 1 is a general view of the image forming system relating to the embodiment of the invention.

In FIG. 1, an image forming system 1 relating to an embodiment of the invention is shown. The image forming system 1 is constructed by connecting a host device 2 such as a PC (personal computer) to, for example, a plurality of image forming apparatuses 10 via a network 3. The host device 2 may be a control device such as an MCU (Micro Controller Unit), an input/output device such as a touch panel, or a terminal other than a PC, having a communications device for transmitting and receiving signals via the network 3. The network 3 may be wired or wireless. It is also possible that a plurality of host devices 2 are connected to the network 3.

Thus, the image forming system 1 is constructed so that the host device 2 can control the image forming apparatuses 10 via the network 3.

Figure 2:
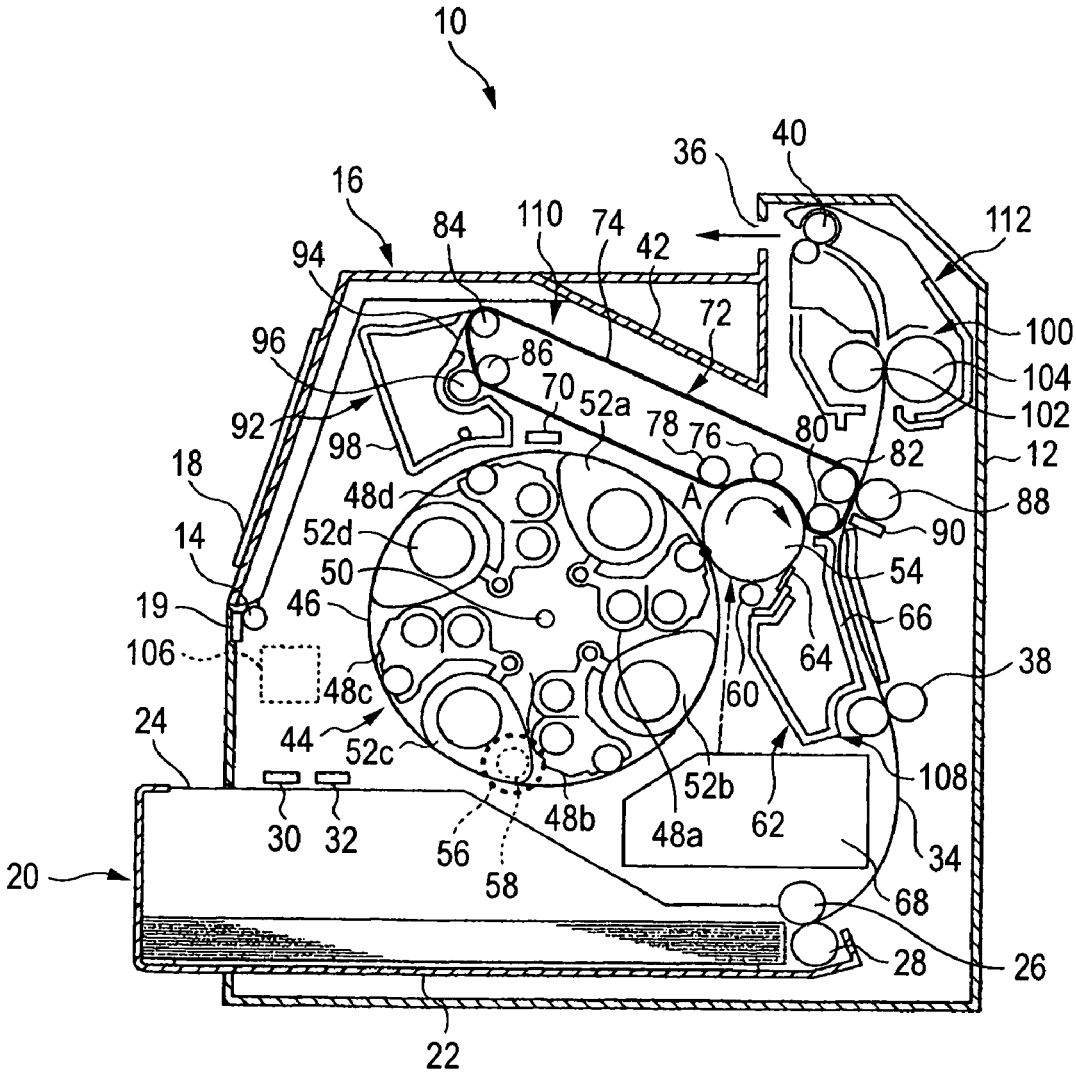
FIG. 2 is a side view showing the outline of the image forming apparatus relating to the embodiment of the invention.

In FIG. 2, the outline of the image forming apparatus 10 is shown. The image forming apparatus 10 has an image forming apparatus main body 12, and is provided with an opening and closing cover 16 that is rotatable around a rotation fulcrum 14 at the upper part of this image forming apparatus main body 12. On the front side of the opening and closing cover 16 (the left side in FIG. 2), a user interface (UI device) 18 such as a touch panel is provided. The UI device 18 displays control information and instruction information of the image forming apparatus 10, and receives inputs made by a user such as instruction information. Namely, a user can operate the image forming apparatus 10 via the UI device 18. The UI device 18 may receive only inputs of a switch or the like, or may only output display or the like, and may perform a combined function of these.

Near the rotation fulcrum 14, an opening and closing detection sensor 19 for detecting the opening and closing of the opening and closing cover 16 by, for example, contact and separation according to the opening and closing of the opening and closing cover 16.

At the lower part of the image forming apparatus main body 12, for example, a one-stage paper feed unit 20 is disposed. The paper feed unit 20 includes a paper feed unit main body 22 and a paper feed cassette 24 housing sheets. At the upper part near the deep end of the paper feed cassette 22, a feed roll 26 for feeding sheets from the paper feed cassette 24 and a retard roll 28 that handles sheets to be supplied one by one are disposed. Above the paper feed cassette 24, a temperature sensor 30 for detecting a temperature inside the image forming apparatus main body 12 and a humidity sensor 32 for detecting a humidity inside the image forming apparatus main body 12 are provided.

A conveyance path 34 is a sheet passage extending from the feed roll 26 to an eject opening 36, and this conveyance path 34 is positioned near the back side (the right side surface of FIG. 2) of the image forming apparatus main body 12 and formed roughly vertically from the paper feed unit 20 to a fixing device 100 that is described later. A secondary transfer roll 88 and a secondary transfer backup roll 82, described later, are disposed on the upstream side of the fixing device 100 of the conveyance path 34, and on the upstream side of the secondary transfer roll 88 and the secondary transfer backup roll 82, a resist roll 38 is disposed. Near the eject opening 36 of the conveyance path 34, an eject roll 40 is disposed.

Therefore, sheets fed by the feed roll 26 from the paper feed cassette 24 of the paper feed unit 20 are handled by the retard roll 28, only the top sheet is guided to the conveyance path 34 and temporarily stopped by the resist roll 38, pass between the secondary transfer roll 88 and the secondary transfer backup roll 82, described later, at a right timing and toner image is transferred thereon, and this transferred toner image is fixed by the fixing device 100, and the sheet is ejected to the eject opening 36 by the eject roll 40 onto an eject part 42 provided above the opening and closing cover 16. This eject part 42 is inclined so as to be low at an eject opening portion and become gradually higher toward the front side (the left side of FIG. 2).

In the image forming apparatus main body 12, a developing device unit 44 such as a rotary developing device is provided at roughly the center part. The developing device unit 44 has a developing device unit main body 46, and to this developing device unit main body 46, four developing devices 48*a* through 48*d* for forming toner images are attached. These developing devices 48*a* through 48*d* rotate leftward (counterclockwise in FIG. 2) together with the developing device unit main body 46 around a rotation shaft 50. To the developing devices 48*a* through 48*d*, cylindrical toner cartridges 52*a* through 52*d* for housing toners of yellow (Y), magenta (M), cyan (C), and black (K) are attached, respectively. The toner cartridges 52*a* through 52*d* match their outer surfaces with the outer circumference of the developing device unit main body 46 when they are attached to the developing device unit main body 46 via the developing devices 48*a* through 48*d*.

In the developing device unit 44, an image carrier 54 formed by, for example, a photoreceptor is disposed so as to be in contact from the back side (the right side in FIG. 2) of the image forming apparatus 10. Namely, in the developing device unit 44, four colors of Y, M, C, and K are prepared for full-color development, and the developing devices 48*a* through 48*d* are rotated and moved and positioned at positions opposing the image carrier 54, and develop a latent image on the image carrier 54 with toners of yellow (Y), magenta (M), cyan (C), and black (K) one color at time.

Near a position roughly opposite the image carrier 54 across the rotation shaft 50 of the developing device unit 44, a wireless communications part 56 is disposed. The wireless communications part 56 has an antenna 58, and performs wireless communications with memory chips 170 described later.

Below the image carrier 54, a charging device 60 including, for example, a charging roll for evenly charging the image carrier 54 is provided. Furthermore, at the more upstream side than the charging device 60 in the rotating direction of the image carrier 54, an image carrier cleaner 62 is in contact. The image carrier cleaner 62 includes a cleaning blade 64 for scraping off toner remaining on the image carrier 54, for example, after primary transfer, and a waste toner collecting bottle 66 for collecting toner scraped off by the cleaning blade 64.

On the back side (right side in FIG. 2) of the waste toner collecting bottle 66, for example, a rib is formed, which is curved so that sheets are conveyed smoothly and forms a part of the conveyance path 34.

Below the back side of the developing device unit 44, an exposure device 68 for writing a latent image onto the image carrier 54 charged by the charging device 60 by using light rays such as laser beams is provided. Above the developing device unit 44, a non-use detection sensor 70 such as a reflection-type photosensor for detecting whether or not the toner cartridges 52*a* through 52*d* attached to the developing device unit 44 are unused is provided. Above the developing device unit 44 and the non-use detection sensor 70, an intermediate transfer device 72 is provided which overlaps a toner image in four colors on an intermediate transfer body 74 by primary transfer at a primary transfer position one color for each rotation of an intermediate transfer body 74 and then collectively transfers onto a sheet at a secondary transfer position described later.

The intermediate transfer device 72 includes an intermediate transfer body 74 such as an intermediate transfer belt, a primary transfer roll 76, a wrap-in roll 78, a wrap-out roll 80, a secondary transfer backup roll 82, a scraper backup roll 84, and a brush backup roll 86. The intermediate transfer body 74 has, for example, elasticity, and is set roughly flat so as to have a long side and a short side above the developing device unit 44. The long side on the upper surface side of the intermediate transfer body 74 is set so as to be roughly parallel to, for example, the eject part 42 provided above the image forming apparatus main body 12. In addition, the intermediate transfer body 74 has a primary transfer part (image carrier wrap region) in wrapping contact with the image carrier 54 between the wrap-in roll 78 disposed on the upstream side of the primary transfer roll 76 on the long side of the lower surface side and a wrap-out roll 80 disposed on the downstream side of the primary transfer roll 76, and the intermediate transfer body wraps around only a predetermined range of the image carrier 54 to follow the rotation of the image carrier 54.

Furthermore, on the back side (the right side of FIG. 2) of the intermediate transfer body 74, a flat part (short side) is formed by the wrap-out roll 80 and the secondary transfer backup roll 82, and this flat part serves as a secondary transfer part and faces the conveyance path 34.

Thus, onto the intermediate transfer body 74, a toner image on the image carrier 54 is primarily transferred by the primary transfer roll 76 by overcoating, for example, yellow, magenta, cyan, and black in order.

The scraper backup roll 84 assists the scraper 94 described later to scrape off toner remaining on the intermediate transfer body 74 after secondary transfer, and the brush backup roll 86 assists the brush roll 96 described later to scrape off toner remaining on the intermediate transfer body 74 after secondary transfer.

The secondary transfer backup roll 82 of the intermediate transfer device 72 faces the secondary transfer roll 88 across the conveyance path 34. Namely, the section between the secondary transfer roll 88 and the secondary transfer backup roll 82 is the secondary transfer position in the secondary transfer part, and the secondary transfer roll 88 secondary-transfers a toner image primarily transferred onto the intermediate transfer body 74 onto the sheet at the secondary transfer position by being assisted by the secondary transfer backup roll 82. Herein, the secondary transfer roll 88 separates from the intermediate transfer body 74 during three rotations of the intermediate transfer body 74, that is, during conveyance of the toner image in three colors of yellow, magenta, and cyan, and when the black toner image is transferred, the secondary transfer roll is made contact with the intermediate transfer body 74. Between the secondary transfer roll 88 and the secondary transfer backup roll 82, a predetermined potential difference is generated, and for example, when the secondary transfer roll 88 is set to a high voltage, the secondary transfer backup roll 82 is connected to a ground (GND).

On the upstream side of the secondary transfer position, an image density sensor 90 such as a reflection-type photosensor is disposed so as to be opposite the intermediate transfer body 74 across the conveyance path 34. The image density sensor 90 reads a patch of toner formed on the intermediate transfer body 74 and detects the density of the image formed on the intermediate transfer body 74.

On the end opposite the image carrier side of the intermediate transfer body 74, the intermediate transfer body cleaner 92 is provided in contact. The intermediate transfer body cleaner 92 includes, for example, a scraper 94 for cleaning by scraping off toner remaining on the intermediate transfer body 74 after secondary transfer, a brush roll 96 for further scraping off the toner remaining after cleaning by the scraper 94, and a waste toner collecting bottle 98 for collecting toner scraped off by the scraper 94 and the brush roll 96. The scraper 94 is formed of, for example, a stainless-steel thin plate, to which a voltage with polarity reverse to that of the toner is applied. The brush roll 96 is formed of, for example, a conductivity-processed acryl brush. While the intermediate transfer body 74 conveys the toner image, the scraper 94 and the brush roll 96 separate from the intermediate transfer body 74, and these are made contact with the intermediate transfer body 74 in a predetermined timing together.

Above the secondary transfer position, a fixing device 100 is disposed. The fixing device 100 has a heating roll 102 and a pressurizing roll 104, fixes the toner image that was secondary-transferred by the secondary transfer roll 88 and the secondary transfer backup roll 82 onto a sheet, and conveys the sheet to the eject roll 40.

Inside the image forming apparatus main body 12, a control part 106 for controlling the respective parts forming the image forming apparatus 10 is provided.

The image carrier unit 108 is formed by integrating the image carrier 54, the charging device 60, and the image carrier cleaner 62. Furthermore, the image forming unit 110 is formed by integrating the image carrier unit 108, the intermediate transfer device 72, and the intermediate transfer body cleaner 92. The fixing unit 112 is formed by integrating the fixing device 100 and the eject roll 40.

Figure 3:
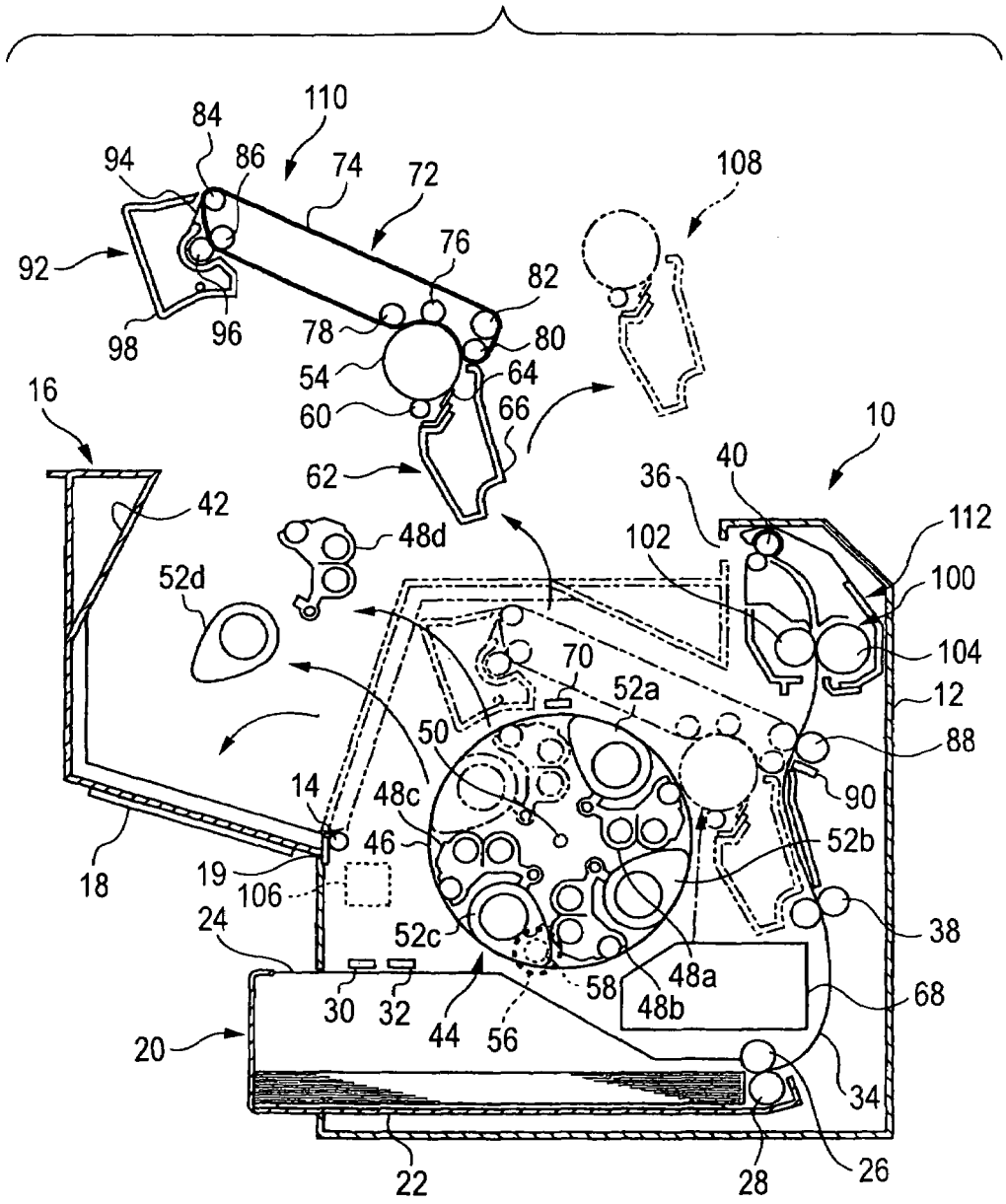
FIG. 3 is a side view illustrating a state where a replaceable unit of the image forming apparatus relating to the embodiment of the invention is detached from the image forming apparatus main body.
Figure 4:
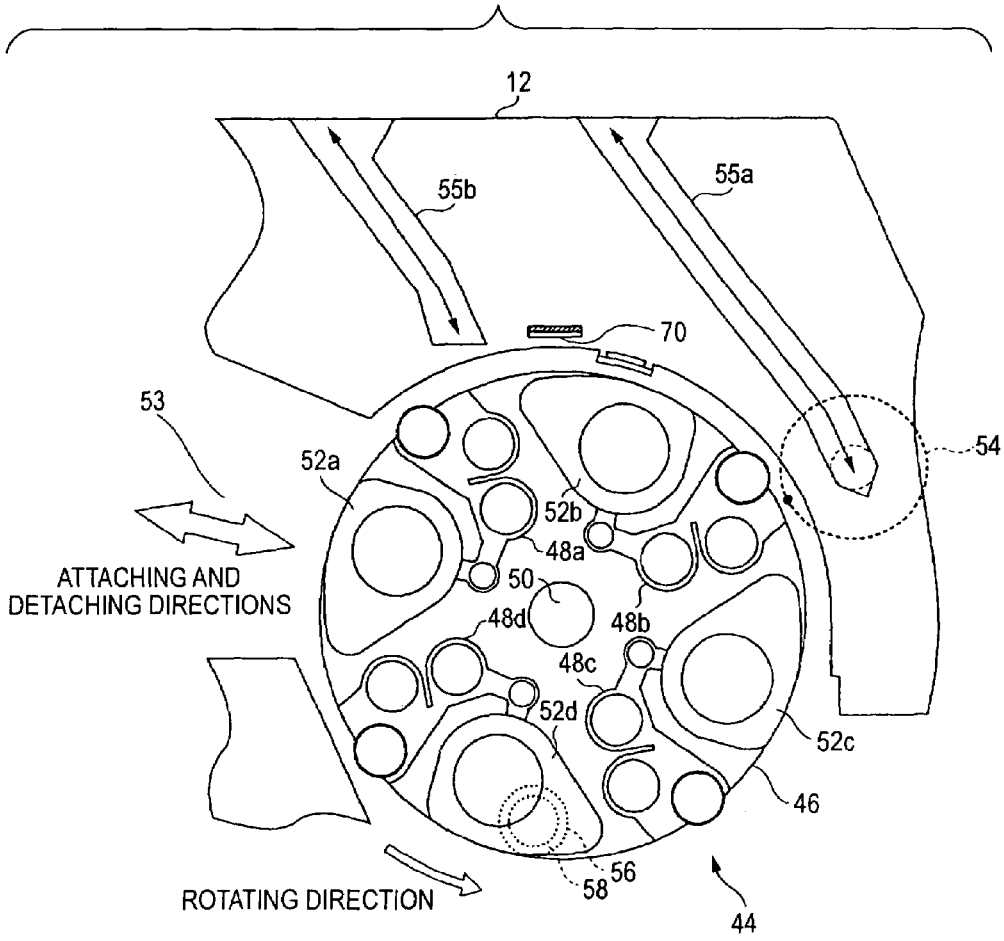
FIG. 4 is a side view showing the directions of attaching and detaching the toner cartridge and the replacing position of the toner cartridge.

In FIG. 3 and FIG. 4, the directions of attaching and detaching the units (replaceable units) are shown.

The image forming unit 110 is attachable to and detachable from the image forming apparatus main body 12, and is attached to and detached from the front side upper part of the image forming apparatus 10 along guides 55*a* and 55*b* provided on the image forming apparatus main body 12 by opening the opening and closing cover 16. The image carrier unit 108 is attachable to and detachable from the image forming unit 110.

Figure 5:
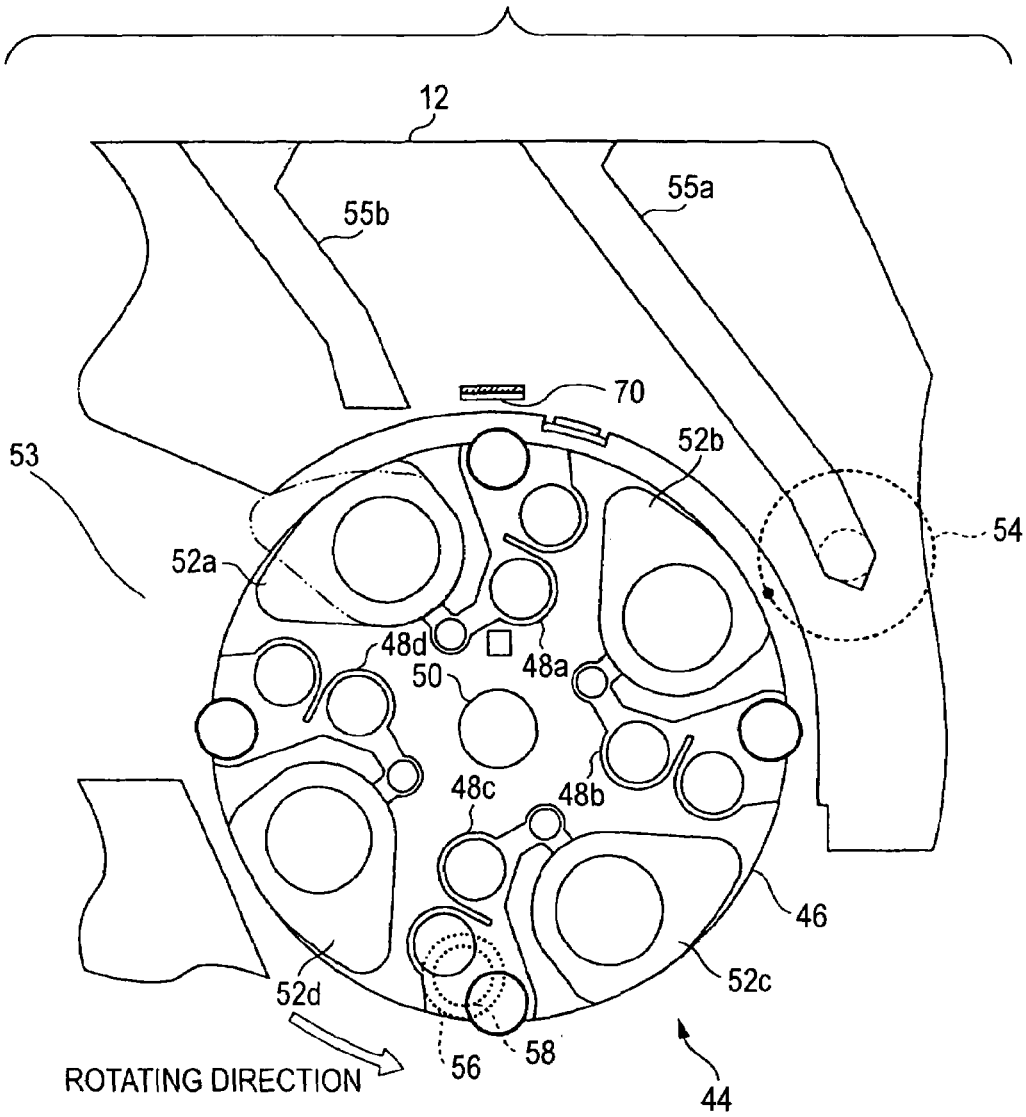
FIG. 5 is a side view showing the stop position of the developing device unit.

The toner cartridges 52*a* through 52*d* are attached to and detached from the front side of the image forming apparatus 10 through a toner cartridge attaching and detaching space 53 by opening the opening and closing cover 16 after they are moved to positions opposing the toner cartridge attaching and detaching space 53 provided at the front side (opening and closing cover 16 side) inside the image forming apparatus main body 12. However, when the developing device unit 44 stops, as shown in FIG. 5, for example, the developing devices 48*a* and 48*c* are lined up roughly vertically and the developing devices 48*b* and 48*d* are lined up roughly horizontally. Namely, a position at which any two of the developing devices 48*a* through 48*d* are lined up roughly vertically, and the other two are lined up roughly horizontally is a stop position (home position) of the developing device unit 44. When the developing device unit 44 stops at the home position, any of the developer cartridges 52*a* through 52*d* are not opposite the toner cartridge attaching and detaching space 53, and any of the developer cartridges 52*a* through 52*d* cannot be replaced. Namely, to replace any of the developer cartridges 52*a* through 52*d*, a user rotates the developing device unit 44 via, for example, the UI device 18 so that any cartridge to be replaced for the developer cartridges 52*a* through 52*d* is positioned opposite the toner cartridge attaching and detaching space 53 (a position for replacing the developer cartridges 52*a* through 52*d*), and thereafter, any cartridge to be replaced for the developer cartridges 52*a* through 52*d* can be replaced.

The developing devices 48*a* through 48*d* (FIG. 3) are attached to and detached from the developing device unit main body 46 when the opening and closing cover 16 is opened and positioned on the front face side (the opening and closing cover 16 side).

The fixing unit 112 is attached to and detached from the image forming apparatus main body 12 by detaching an upper cover that is not shown. Other units including the developing device unit 44 and the paper feed unit 20 are also attachable to and detachable from the image forming apparatus main body 12.

Thus, the respective units are replaceable by a user. On the other hand, when a user attaches a replaceable unit to the image forming apparatus 10, if a unit other than genuine units is attached to the image forming apparatus 10, problems such that excellent image quality cannot be maintained or the operation cannot be guaranteed may occur. The reason for this is that the image forming apparatus 10 is controlled according to the characteristics of members used in the image forming apparatus 10. Therefore, a unit that is replaceable by a user is provided with a sensor for detecting predetermined conditions.

Hereinafter, when any of a plurality of components such as the developing devices 48*a* through 48*d* is shown without being specified, it may be abbreviated to "developing device 48," simply.

An example of a replaceable unit having a sensor or the like for detecting predetermined conditions is described.

Figure 6:
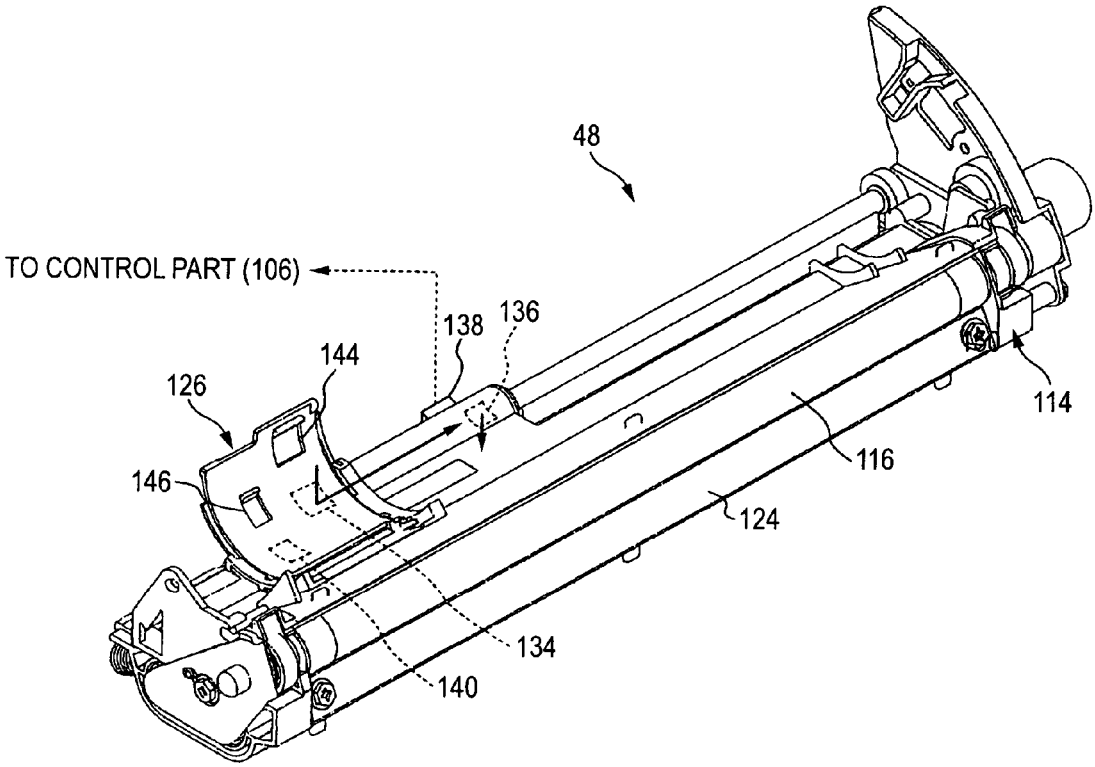
FIG. 6 is a perspective view showing the developing device of the image forming apparatus relating to the embodiment of the invention.
Figure 7:
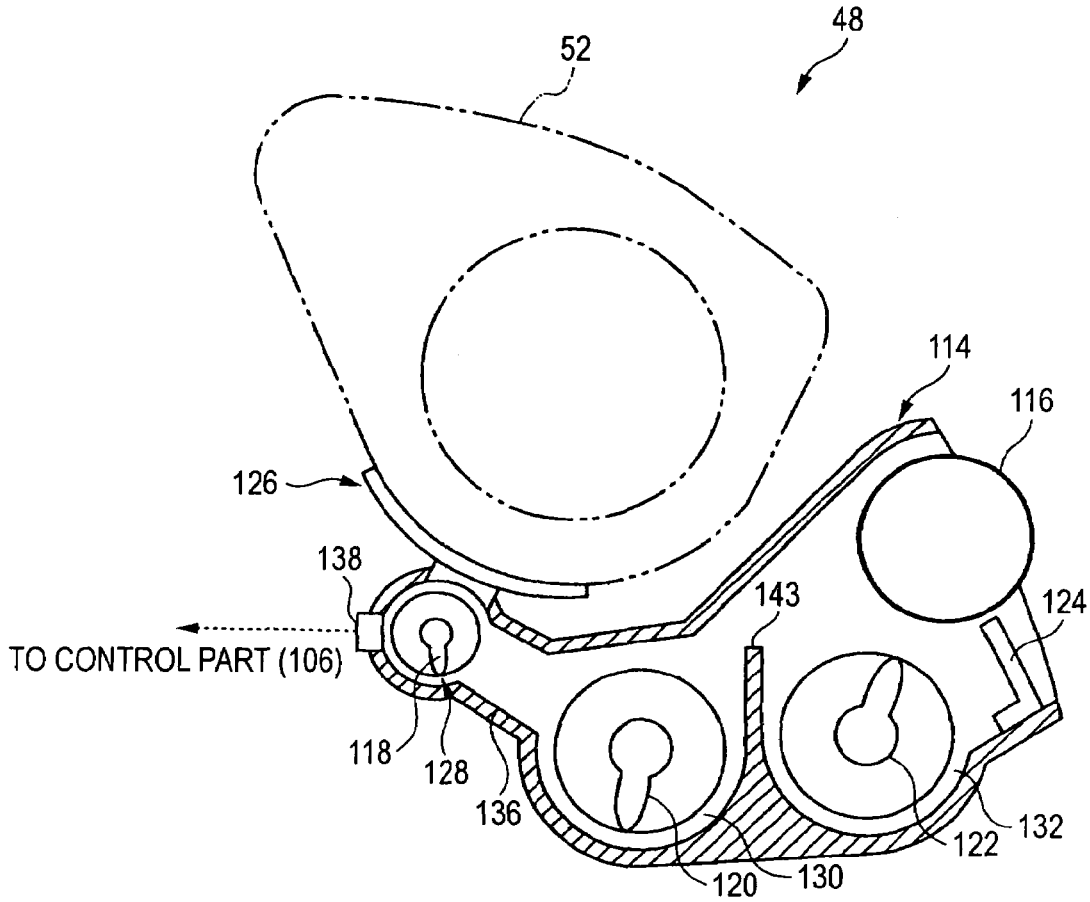
FIG. 7 is a schematic view showing a section of the developing device of the image forming apparatus relating to the embodiment of the invention.

In FIG. 6 and FIG. 7, the arrangement of a developing device 48 that is a replaceable unit is shown.

The developing device 48 includes a developing roll 116 as a developer carrier disposed on the image carrier 54 side of the developing device housing (developing device main body) 114, a first auger 118, a second auger 120, a third auger 122, and a layer thickness limiting member 124, and houses a two-component-based developer made by, for example, a nonmagnetic toner and a magnetic carrier.

The developing device housing 114 includes a shutter 126 for opening and closing a toner receiving opening 134 and a developer discharge opening 140 described later, a cylindrical taking-in conveyance path 128 for conveying toner taken from the toner cartridge 52, and cylindrical developer conveyance paths 130 and 132 for stirring and conveying toner and carrier.

The taking-in conveyance path 128 includes a toner receiving opening 134 for receiving toner from the toner cartridge 52 and a toner feeding opening 136 for feeding toner into the developer conveyance path 130, and inside the taking-in conveyance path 128, the first auger 118 is provided. The first auger 118 conveys toner received in the taking-in conveyance path 128 from the toner cartridge 52 to the developer conveyance path 130. By adjusting the rotation of the first auger 118, the toner amount to be supplied to the developing device 48 from the toner cartridge 52 is adjusted. Therefore, by accumulating the drive period and the number of rotations of the first auger 118 by a CPU 202 described later, the amount used for the toner (the amount used for the toner cartridge 52) is calculated. Furthermore, it is also possible that the current flowing when the exposure device 68 writes an electrostatic latent image on the image carrier 54 is charged as electrical charges in a capacitor, etc., and the number of times of reaching of the accumulated charges to a predetermined amount is counted by the CPU, whereby the amount used for the toner is calculated.

In the taking-in conveyance path 128, a toner existence detection sensor 138 is provided between the toner receiving opening 134 and the toner feeding opening 136, and this toner existence detection sensor 138 detects the existence of toner inside the taking-in conveyance path 128 by detecting a change in resistance value due to existence of toner between, for example, two points inside the taking-in conveyance path 128. The toner existence detection sensor 138 may be a piezoelectric element.

The developer conveyance path 130 has a developer discharge opening 140 for discharging surplus developer to the toner cartridge 52, and inside the developer conveyance path 130, a second auger 120 is provided. The second auger 120 stirs and mixes toner conveyed through the taking-in conveyance path 128 and carrier and conveys them to the developer conveyance path 132.

Inside the developer conveyance path 132, a third auger 122 is provided. The third auger 122 stirs and conveys the developer conveyed through the developer conveyance path 130 and supplies it to the developing roll 116.

Between the developer conveyance path 130 and the developer conveyance path 132, a partition 143 is provided, and on both ends of the partition 143, a path (not shown) for connecting the developer conveyance path 130 and the developer conveyance path 132 is provided. Therefore, the second auger 120 and the third auger 122 convey the developer in directions alternating with each other, the toner is frictionally charged to a charge amount with predetermined polarity by the carrier, and circulated inside the developing device housing 114. Furthermore, the deteriorated developer is discharged from the developer discharge opening 140 to the toner cartridge 52 in a predetermined timing, whereby the total life of the developer is extended (trickle developing method).

The shutter 126 has openings 144 and 146, and by overlapping the opening 144 with the toner receiving opening 134, a toner path from the toner cartridge 52 to the developing device 48 is formed, and by overlapping the opening 146 with the developer discharge opening 140, a path for surplus developer from the developing device 48 to the toner cartridge 52 is formed.

The developing roll 116 develops an electrostatic latent image carried on the image carrier 54 with toner by contact with the image carrier 54 while carrying the toner. The layer thickness limiting member 124 limits the layer thickness of the toner to be carried by the developing roll 116.

Figure 8:
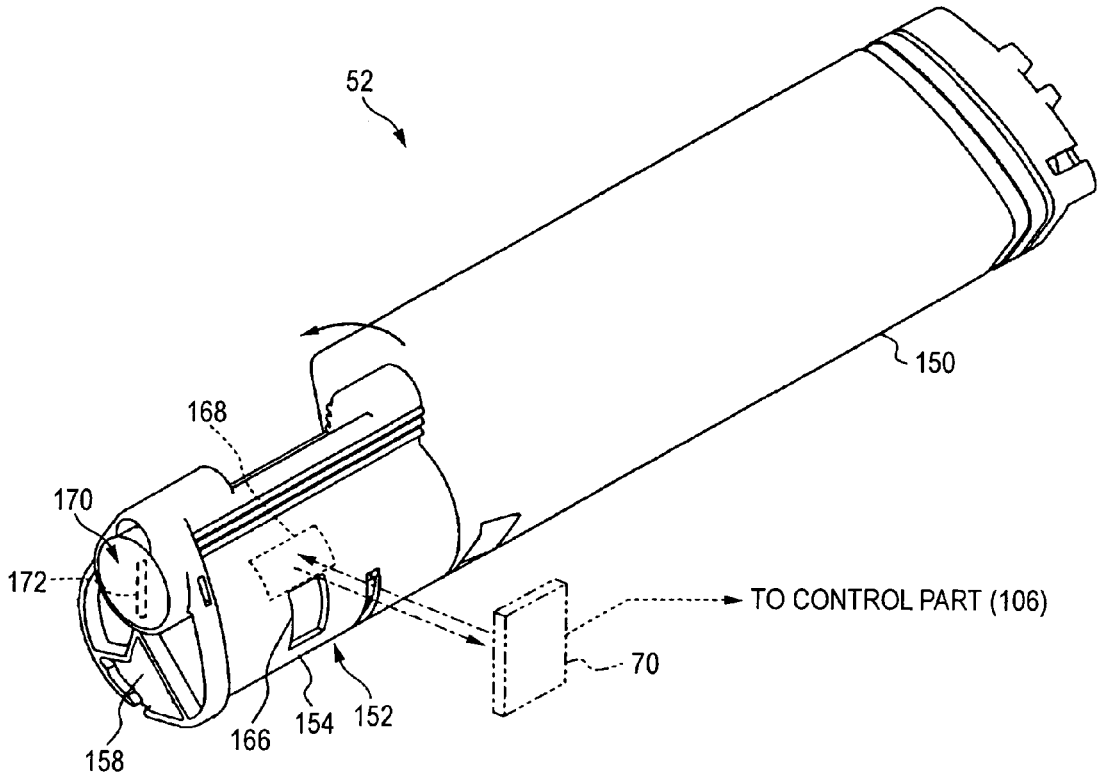
FIG. 8 is a perspective view showing the toner cartridge of the image forming apparatus relating to the embodiment of the invention.
Figure 9:
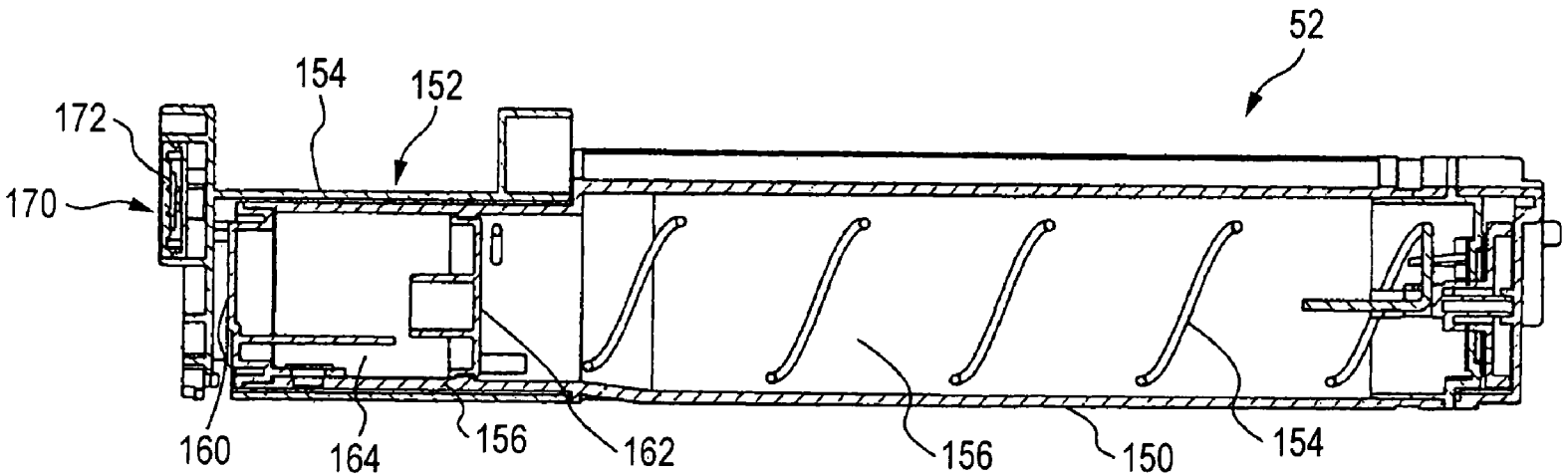
FIG. 9 is a sectional view showing the toner cartridge of the image forming apparatus relating to the embodiment of the invention.

In FIG. 8 and FIG. 9, the arrangement of the toner cartridge 52 as a replaceable unit is shown.

The toner cartridge 52 has a toner cartridge main body 150 and a rotating part 152 provided on one end in the longitudinal direction of the toner cartridge main body 150.

The toner cartridge main body 150 is formed into a cylindrical shape so that a roughly cylindrical portion where a stirring conveying member 154 is provided inside and a portion extended and gradually narrowed from the roughly cylindrical portion in the direction roughly perpendicular to the longitudinal direction are integrated together. Furthermore, the toner cartridge main body 150 roughly matches its outer surface with the outer circumference of the developing device unit main body 46 when the toner cartridge 52 is attached to the developing device unit main body 46 via the developing device 48.

Inside the toner cartridge main body 150, a toner housing space 156 is created for housing toner to be supplied to the developing device 48. In the toner housing space 156, the above-mentioned stirring conveying member 154 is provided. This stirring conveying member 154 is, for example, spirally wound, which stirs the toner inside the toner housing space 156 and conveys it to the toner receiving opening 134 of the developing device 48.

The rotating part 152 includes a rotating part main body 154 and a cylinder part 156 provided inside the rotating part main body 154 and formed integrally with the toner cartridge main body 150. The cylinder part 156 is closely sealed on its side surface part 158 side of the rotating part main body 154 by a cylinder part side wall 160, and an isolating wall 162 is provided inside. On the cylinder part side wall 160 side of the isolating wall 162, a developer collecting space 164 for collecting surplus developer from the developing device 48 is formed, and on the side opposite the cylinder part side wall 160 side of the isolating wall 162, the above-mentioned toner housing space 156 is extended.

The rotating part main body 154 has a window part 166 covered by a transparent member, and the inside is formed into a cylinder shape so as to rotate along the cylindrical part outer surface of the cylinder part 156. On the cylindrical part outer surface of the cylinder part 156, a reflection member 168 such as white tape is attached, and when the toner cartridge 52 is attached to the developing device 48 and the rotating part main body 154 rotates, the reflection member 168 is exposed through the window part 166. Furthermore, inside the image forming apparatus main body 12, when the developer unit 44 attached with the toner cartridge 52 rotates, the exposed reflection member 168 passes through a position opposite the non-use detection sensor 70 fixed to the image forming apparatus main body 12. As described above, the non-use detection sensor 70 is, for example, a reflection-type photosensor, and when the reflection member 168 of the toner cartridge 52 attached to the developing device unit 44 passes through the position opposite the non-use detection sensor 70, the reflection member 168 detects the reflection amount that changes due to stain by the toner, whereby it is judged whether or not the toner cartridge 52 is unused.

To the side surface part 158 of the rotating part main body 154, memory chip 170 is attached. The memory chip 170 has an antenna 172, and makes wireless communication with the wireless communications part 56 provided on the image forming apparatus main body 12 side.

Next, regarding the wireless communications part 56 and the memory chips 170, their circuitry and communications among these are described.

Figure 10:
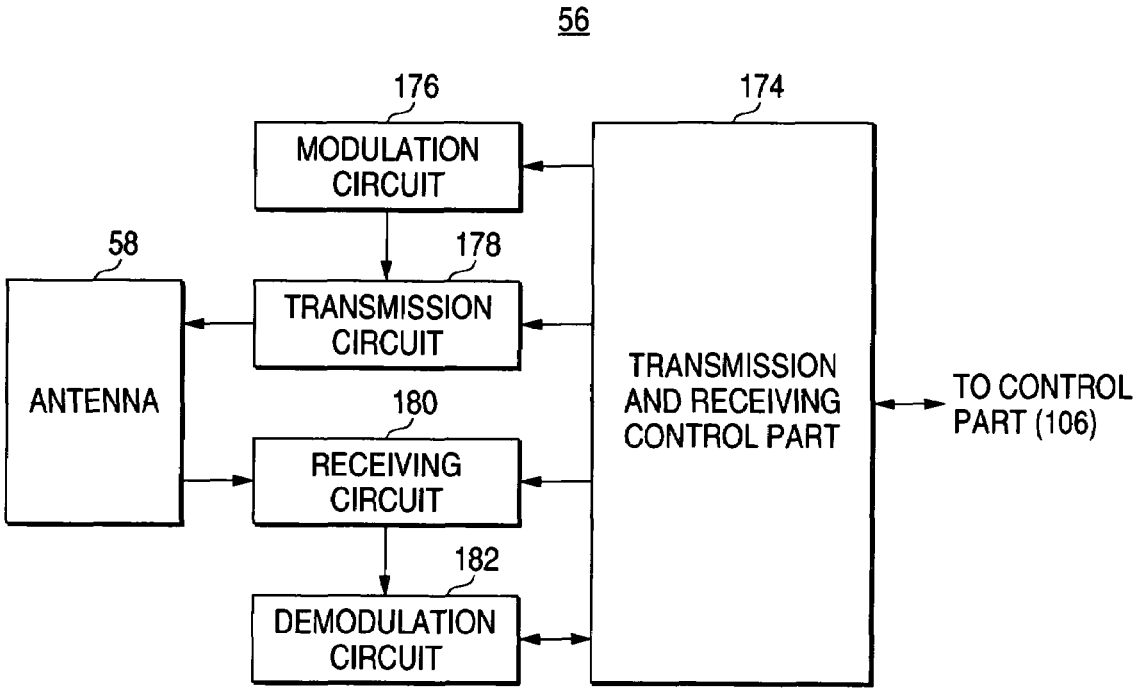
FIG. 10 is a block diagram showing the circuitry of the wireless communications part of the image forming apparatus relating to the embodiment of the invention.
Figure 11:
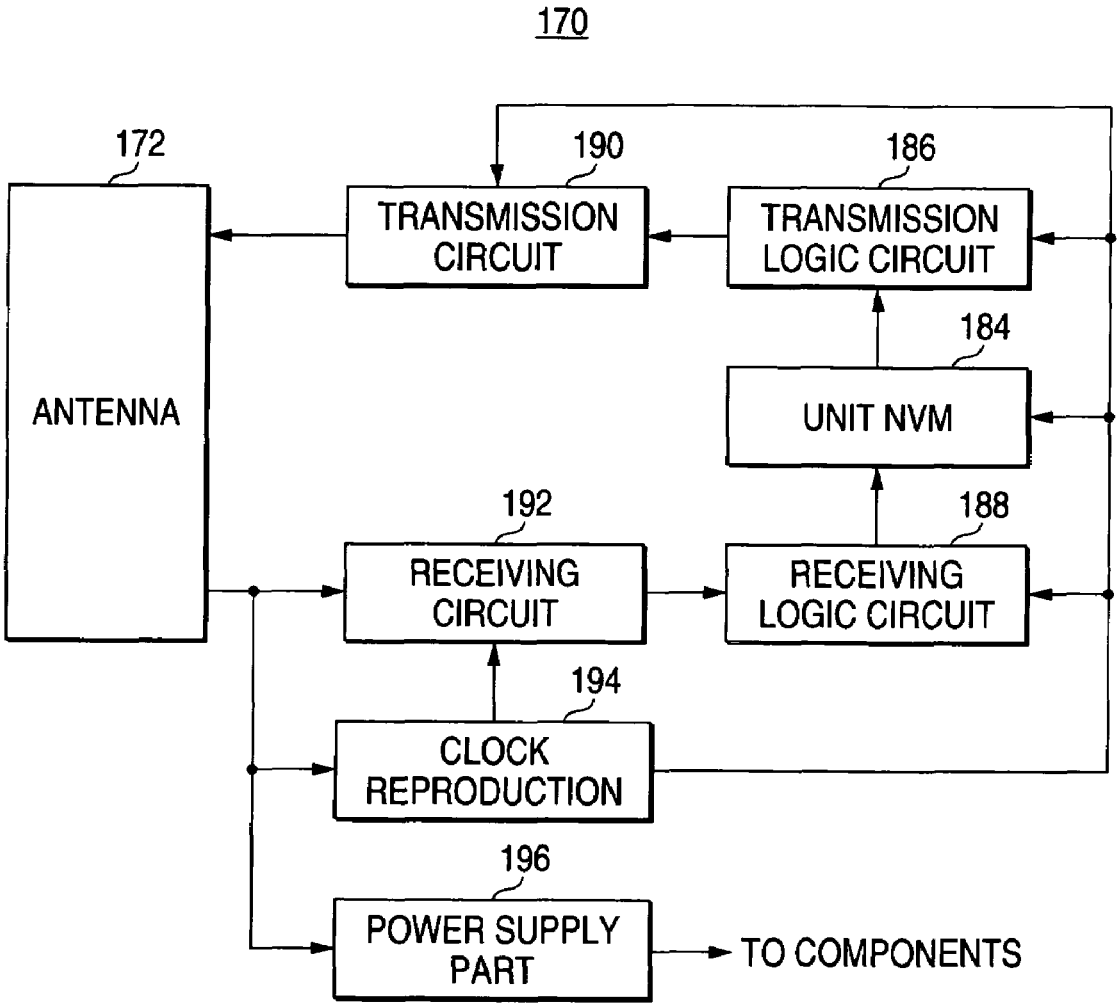
FIG. 11 is a block diagram showing the circuitry of the memory chip of the toner cartridge used in the image forming apparatus relating to the embodiment of the invention.

FIG. 10 is a block diagram showing the circuitry of the wireless communications part 56. FIG. 11 is a block diagram showing the circuitry of the memory chip 170.

As shown in FIG. 10, the circuit of the wireless communications part 56 includes a transmission and receiving control part 174, a modulation circuit 176, a transmission circuit 178, a receiving circuit 180, a demodulation circuit 182 and an antenna 58. In the wireless communications part 56, the transmission and receiving control part 174 controls operations of the components of the wireless communications part 56. Then, the transmission and receiving control part 174 outputs data inputted from the control part 106 to the modulation circuit 176. The transmission and receiving control part 174 outputs data received by the receiving circuit 180 and demodulated by the demodulation circuit 182 to the control part 106. The modulation circuit 176 modulates the data inputted from the transmission and receiving control part 174 and outputs it to the transmission circuit 178. The transmission circuit 178 outputs a radio wave signal containing data to be stored in the memory chip 170 and clock signals to the memory chip 170 via the antenna 58.

The receiving circuit 180 receives a signal transmitted from the memory chip 170 via the antenna 58 and outputs it to the demodulation circuit 182. The demodulation circuit 182 outputs the data transmitted from the memory chip 170 on the basis of the signal change inputted from the receiving circuit 180 and outputs it to the transmission and receiving control part 174.

As shown in FIG. 11, the circuit of the memory chip 170 includes a unit NVM (Non Volatile Memory) 184, a transmission logic circuit 186, a receiving logic circuit 188, a transmission circuit 190, a receiving circuit 192, a clock reproduction circuit 194, a power supply part 196, and an antenna 172.

The receiving circuit 192, the clock reproduction circuit 194, and the power supply part 196 receive a radio wave signal via the antenna 172 when the radio wave signal is transmitted to the memory chip 170 from the wireless communications part 56. In the memory chip 170, the power supply part 196 rectifies a current generated by electromagnetic induction by the radio wave signal, and supplies electrical power necessary for operations of components of the memory chip 170 to the components. The memory chip 170 may be constructed so as to be supplied with electrical power from the main body part 40 when it requires a voltage higher than the voltage generated by the power supply part 196. For example, the electrical power may be supplied from the alternating current supplied to the developing device unit 44 without contact by further providing a power supply coil or the like in the memory chip 170.

The clock reproduction circuit 194 reproduces a clock signal when receiving a radio wave signal and outputs it to the circuits forming the memory chip 170. When the receiving circuit 192 receives a radio wave signal, the receiving circuit outputs signals such as data contained in the radio wave signal to the receiving logic circuit 188 in synch with a clock signal inputted from the clock reproduction circuit 194. The receiving logic circuit 188 demodulates the signals such as data inputted from the receiving circuit 192 in synch with the clock signal inputted from the clock reproduction circuit 194, and outputs the data to the unit NVM 184.

The unit NVM 184 is a writable nonvolatile memory, and when the signal inputted from the receiving logic circuit 188 in synch with the clock signal inputted from the clock reproduction circuit 194 indicates data writing, writing (storing) of corresponding data is performed, and when the signal indicates data reading, data stored in the unit NVM 184 is outputted to the transmission logic circuit 186. The nonvolatile memory included in the unit NVM 184 may be, for example, a flash ROM, EEPROM, or FeRAM (ferroelectric memory).

The transmission logic circuit 186 modulates the data inputted from the unit NVM 184 in synch with the clock signal inputted from the clock reproduction circuit 194 and outputs it to the transmission circuit 190. The transmission circuit 190 outputs the signal inputted from the transmission logic circuit 186 to the wireless communications part 56 as a radio wave signal via the antenna 172 in synch with the clock signal inputted from the clock reproduction circuit 194.

The signal to be transmitted and received as a radio wave signal may be transmitted and received by being converted into a radio wave signal after being encoded. For example, it may be allowed that an authorized user rewrites the contents of the unit NVM 184 from a device other than the control part 106 by using the encoded radio wave signal.

Figure 12:
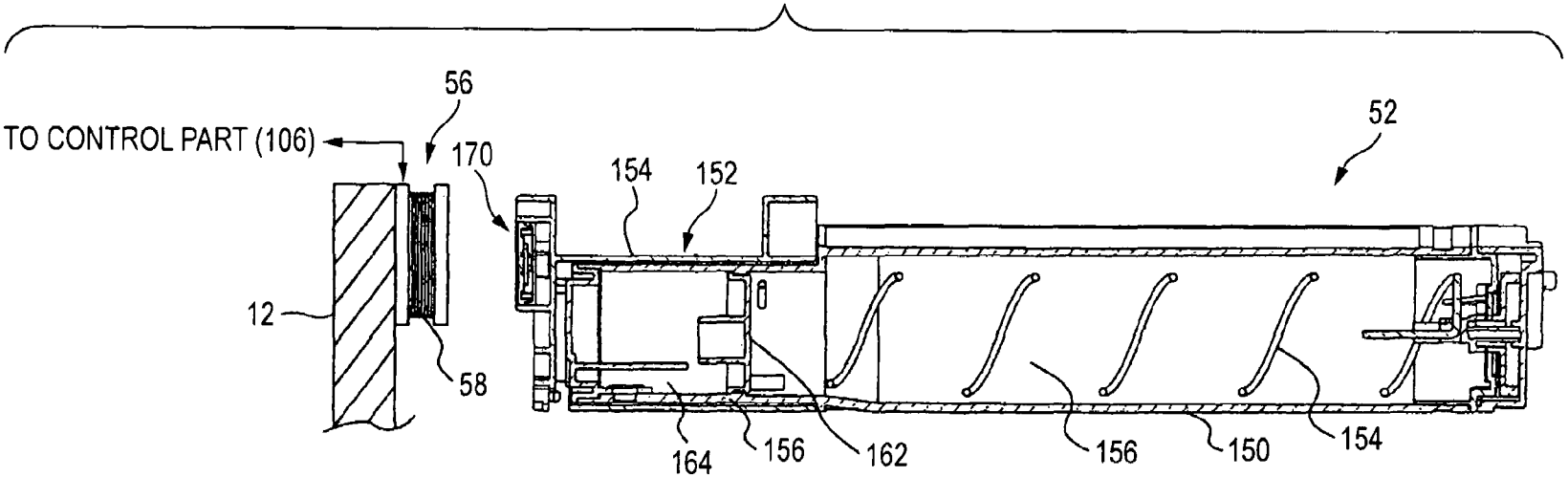
FIG. 12 is a sectional view showing the positional relationship of the wireless communications part and the memory chip which make wireless communications with each other.

In FIG. 12, the positional relationship of the wireless communications part 56 and the memory chips 170 which make wireless communications with each other is shown. As described above, the toner cartridge 52 is attached to each developing device 48, and moves by rotating the developing unit 44 (FIG. 2) around the rotation shaft 50. The wireless communications part 56 is fixed to the image forming apparatus main body 12 near the side of the developing device unit 44 so as to oppose the memory chips 170 in order that are moved by rotation of the developing device unit 44, and is constructed to make wireless communications with any of the memory chips 170 while the developing device 48 is controlled to move and stopped at this opposite position. The wireless communications part 56 confirms the start of data transmission and receiving by receiving an acknowledge signal outputted from the memory chip 170 with respect to, for example, a radio wave signal outputted from the wireless communications part 56.

Figure 13:
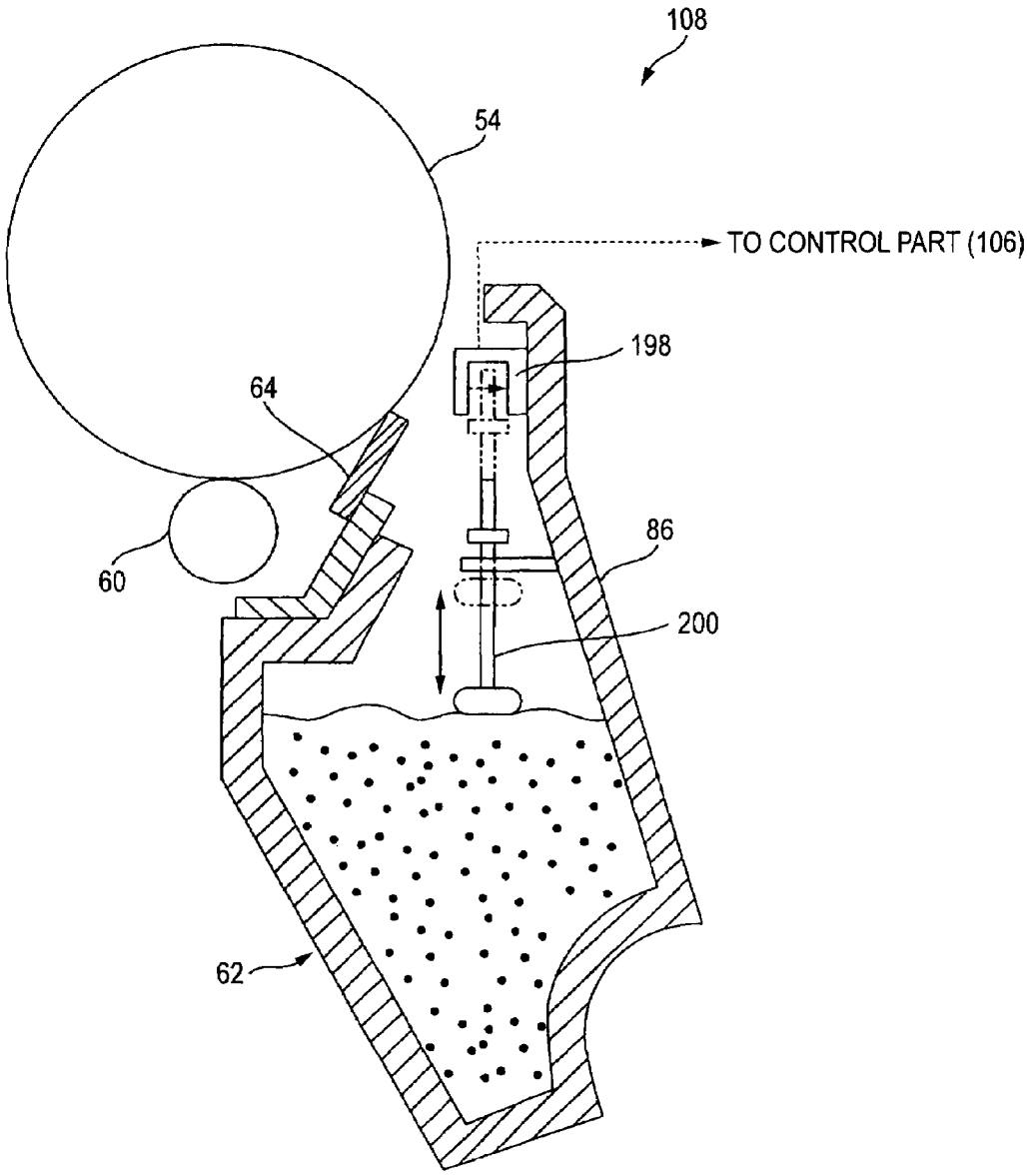
FIG. 13 is a side view showing the arrangement of the image carrier unit to be used in the image forming apparatus relating to the embodiment of the invention.

In FIG. 13, the arrangement of the image carrier unit 108 as a replaceable unit is shown.

As described above, the image carrier unit 108 is formed by integrating the image carrier 54, the charging device 60, and the image carrier cleaner 62, and includes, for example, a waste toner full sensor 198 disposed at the upper part inside the image carrier cleaner 62, and a float 200 disposed below the waste toner full sensor 198. The waste toner full sensor 198 has an optical path in which light emission of a light emitting part provided on one side is received by a light receiving part provided on the other side, and outputs a signal indicating whether or not the light receiving part has received light to the control part 106. The float 200 is raised when the waste toner collected inside the waste toner collecting bottle 66 exceeds a predetermined amount, and when the waste toner collecting bottle 66 is filled with waste toner, the float blocks the optical path of the waste toner full sensor 198. Thus, the image carrier unit 108 detects whether or not the waste toner collecting bottle 66 is full by means of the waste toner full sensor 198 and the float 200, and outputs the results of detection to the control part 106.

Furthermore, it is also possible that the waste toner full sensor 198 and the float 200 are provided on the intermediate transfer body cleaner 92 and it is judged whether or not the waste toner collecting bottle 98 is full.

Thus, the replaceable unit having a sensor for detecting predetermined conditions outputs the results of detection made by the sensor to the control part 106, and the control part 106 controls the respective parts forming the image forming apparatus 10 on the basis of the inputted detection results.

Next, the arrangement of the control part 106 is described in detail.

Figure 14:
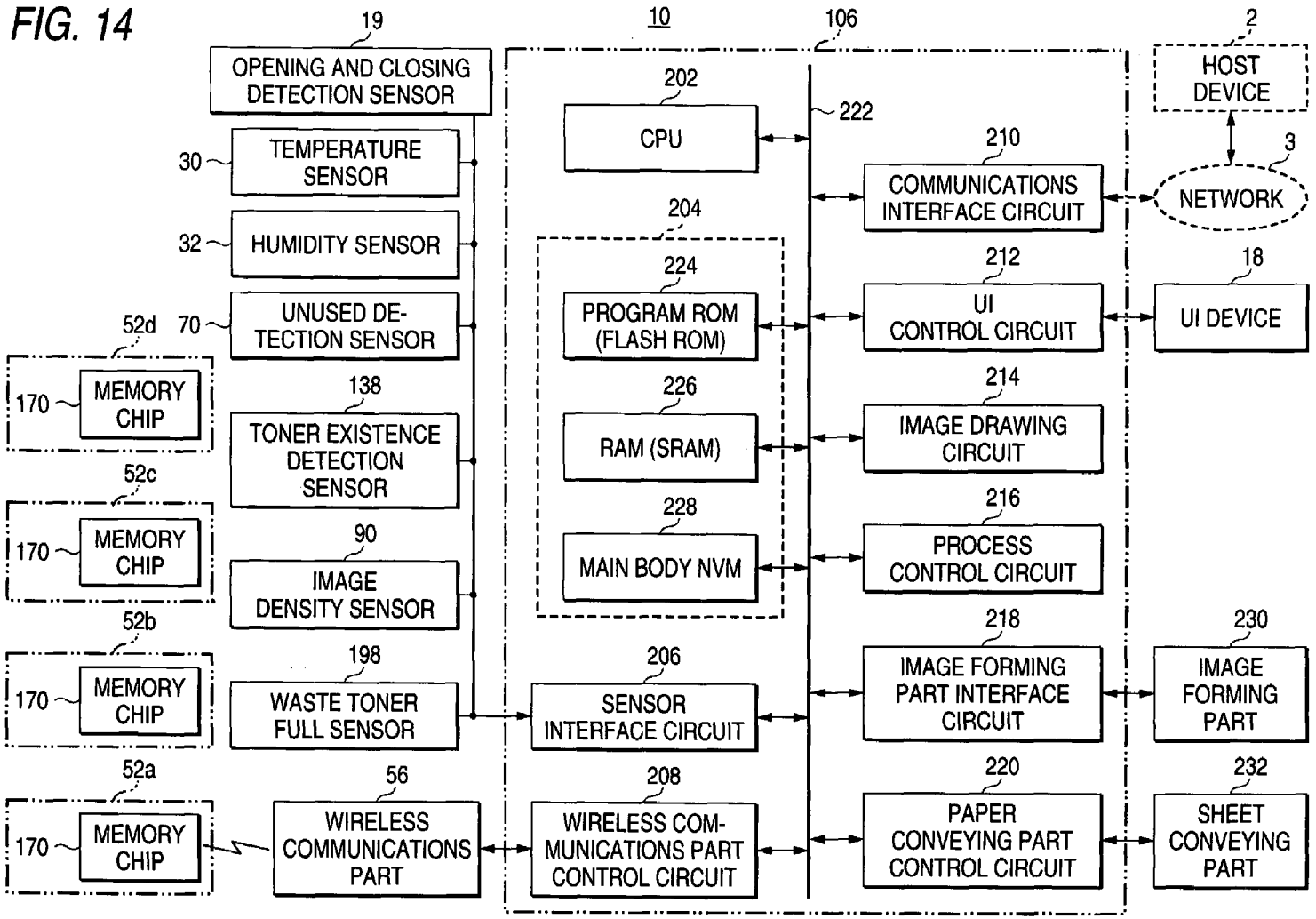
FIG. 14 is a block diagram showing the arrangement of the control part of the image forming apparatus relating to the embodiment of the invention, and the respective parts to be connected to the control part.

FIG. 14 is a block diagram showing the arrangement of the control part 106 and the respective parts to be connected to the control part 106.

The control part 106 includes a CPU 202, a storage part 204, a sensor interface (sensor I/F) circuit 206, a wireless communications part control circuit 208, a communications interface (communications I/F) circuit 210, a user interface (UI) control circuit 212, an image drawing circuit 214, a process control circuit 216, an image forming part interface (image forming I/F) circuit 218, and a sheet conveyance part control circuit 220, and signals can be inputted and outputted via the system bus 222 among these.

The CPU 202 transmits and receives signals between the same and the parts forming the control part 106 via the system bus 222 and controls the parts forming the control part 106.

The storage part 204 includes a program ROM 224, a RAM 226, and a main body NVM (Non Volatile Memory) 228, and stores information necessary for controlling the image forming apparatus 10. The program ROM 224 consists of, for example, a flash ROM or the like, and the contents stored therein may be updated. The RAM 226 consists of, for example, an SRAM or the like, and stores temporary information such as drawing data inputted from the image drawing circuit 214. The main body NVM 228 consists of an electrically rewritable nonvolatile memory such as an EEPROM or flash ROM. The main body NVM 228 is a rewritable storage device, and may be an SRAM, HDD (Hard Disk Drive) or optical memory the power supply of which is backed up by a battery as long as it can hold data even when the power supply of the image forming apparatus 10 is turned off.

The sensor I/F circuit 206 receives detection results from the opening and closing detection sensor 19, the temperature sensor 30, the humidity sensor 32, the non-use detection sensor 70, the toner existence detection sensor 138, the image density sensor 90, and the waste toner full sensor 198, respectively, and outputs them to the CPU 202 via the system bus 222. The wireless communications part control circuit 208 transmits and receives signals between the same and the four memory chips 170 provided for each of the toner cartridges 52*a* through 52*d*, and transmits and receives signals between the same and the CPU 202 and the storage part 204 via the system bus 222, and connects the respective memory chips 170, the CPU 202 and the storage part 204.

The communications I/F circuit 210 transmits and receives signals between the same and the host device 2 via the network 3, transmits and receives signals between the same and the CPU 202 or the like via the system bus 222, and connects the host device 2 and the CPU 202 or the like. The UI control circuit 212 transmits and receives signals between the same and the UI device 18, transmits and receives signals between the same and the CPU 202 or the like via the system bus 222, and connects the UI device 18 and the CPU 202, etc.

The image drawing circuit 214 draws an image on the basis of an image forming signal inputted from the host device 2, etc., and outputs it to the CPU 202 and the RAM 226. The process control circuit 216 controls the image forming part 230 including the exposure device 68, the image forming unit 110, and the developing device unit 44, etc., via the image forming I/F circuit 218 by referring to set values described later stored in the storage part 204 in conjunction with the CPU 202. The sheet conveyance part control circuit 220 controls the sheet conveyance part 232 including the feed roll 26, the retard roll 28, and the resist roll 38, etc., in conjunction with the CPU 202.

Furthermore, the CPU 202 can judge the status of the toner cartridge 52 attached with the memory chips 170 by comparing data stored in the storage part 204 and data stored in the unit NVM 184, so that the memory chips 170 form a part of a detection unit even if the memory chips have no sensors.

Next, the details of data stored in the program ROM 224, the main body NVM 228, and the unit NVM 184 are described.

Figure 15:
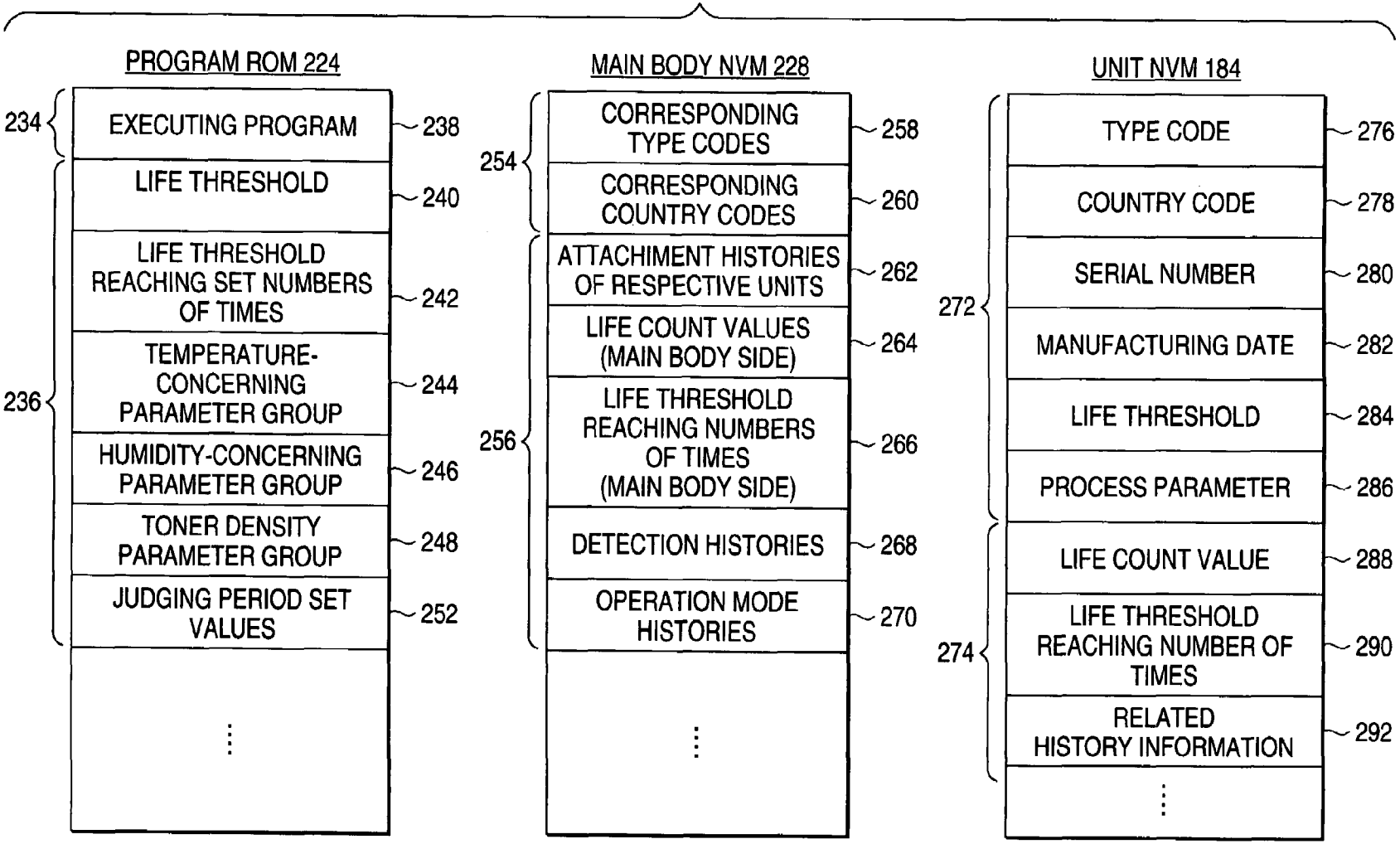
FIG. 15 is a memory map illustrating data to be stored in the program ROM, the main body NVM, and the unit NVM.

In FIG. 15, examples of the data to be stored in the program ROM 224, the main body NVM 228, and the unit NVM 184 are shown.

In the program ROM 224, a program region 234 and a set value region 236, etc., are provided. In the program region 234, an executing program 238 for operating the image forming apparatus 10 is stored. In the set value region 236, life thresholds 240, life threshold reaching set numbers of times 242, a temperature-concerning parameter group 244, a humidity-concerning parameter group 246, a toner density parameter group 248, and judging period set values 252, etc., are stored.

The respective life thresholds include lives (life thresholds) of the replaceable units of the image forming apparatus 10. The life threshold reaching set numbers of times 242 include numbers of times for which the replaceable units of the image forming apparatus 10 are allowed to reach the life thresholds. The temperature-concerning parameter group 244 includes parameters concerning control for the temperature of the image forming apparatus 10. The humidity-concerning parameter group 246 includes parameters concerning control for the humidity of the image forming apparatus 10. The toner density parameter group 248 includes parameters concerning control for the toner density inside the developing device 48. The judging period setting values 252 include the periods (judging periods) until the CPU 202 starts judgment as to whether or not the replaceable units of the image forming apparatus 10 are genuine in the processing to be executed by the image forming apparatus 10 for printing preparation suitable for an operation mode.

In the main body NVM 228, a corresponding unit information region 254 and a main body side update region 256 are provided.

In the corresponding unit information region 254, corresponding type codes 258 and corresponding country codes 260 are stored. For the corresponding type codes 258, a table (data) of types showing that the replaceable units of the image forming apparatus 10 are types adapted to the image forming apparatus 10 is stored. For the corresponding country codes 260, a table (data) of countries in which specifications different among countries are set for the replaceable units of the image forming apparatus 10 is stored.

In the main body side update region 256, attachment histories 262 of the respective units, life count values 264 of the main body side, life threshold reaching numbers of times 266 of the main body side, detection histories 268, and operation mode histories 270, etc., are stored. The attachment histories 262 of the units include attachment histories of the respective replaceable units of the image forming apparatus 10. It is stored that genuine units have been attached in the initial status (initial values) of the attachment histories 262 of the units. The life count values 264 of the main body side include life count values (the amounts used from start of use to the present) of the respective replaceable units of the image forming apparatus 10. The amounts used for the respective units may be calculated from the accumulated operation times of the units. The life threshold reaching numbers of times 266 of the main body side include life threshold reaching numbers of times of the replaceable units of the image forming apparatus 10. The detection histories 268 include histories of detection results detected by the respective sensors provided in the image forming apparatus 10. The operation mode histories 270 include histories of operation modes applied to the respective replaceable units of the image forming apparatus 10.

In the unit NVM 184, the unit information region 272 and the unit side update region 274, etc., are provided.

In the unit information region 272, type codes 276 indicating types, country codes 278 indicating countries in which the specifications are set, and serial numbers 280 unique to the units, manufacturing dates 282, life thresholds 284 indicating the unit lives, process parameters 286 for process control and the like are stored.

In the unit side update region 274, a life count value 288 indicating the amount used from the start of use of the toner cartridge 52 to the present, a life threshold reaching number of times 290 indicating the number of times of reaching the life threshold stored in the life thresholds 284, and related history information 292, etc., are stored. The related history information 292 includes histories of related information available for recognizing the status of the toner cartridge 52 such as the number of rotations of the image carrier 54.

In the image forming apparatus with the above-mentioned arrangement, the image carrier 54 is evenly charged by the charging device 60 when being supplied with an image forming signal, and onto this charged image carrier 54, a light beam is outputted from the exposure device 68 on the basis of the image signal. The light beam from the exposure device 68 exposes the surface of the image carrier 54 to form a latent image.

The latent image carried by the image carrier 54 is developed by the developing device unit 44 at a developing position. In the developing device unit 44, the developing devices 48*a* through 48*d* are supplied with toners of yellow, magenta, cyan, and black from the toner cartridges 52*a* through 52*d*. The developer excessively supplied to the developing devices 48*a* through 48*d* is collected by the toner cartridges 52*a* through 52*d*, respectively. A toner image developed for each color by the developing devices 48*a* through 48*d* of the developing device unit 44 is primarily transferred onto the intermediate transfer body 74 in an overlapping manner. In the primary transfer, waste toner remaining on the image carrier 54 is scraped off by the image carrier cleaner 62 and collected.

On the other hand, a sheet housed in the paper feed cassette 24 is forwarded by the feed roll 26 in response to a paper feed signal, etc., handled by the retard roll 28 and guided to the conveyance path 34, temporarily stopped by the resist roll 38, and guided between the secondary transfer roll 88 and the secondary transfer backup roll 82 at a right timing. When the sheet is guided between the secondary transfer roll 88 and the secondary transfer backup roll 82, a toner image in four colors overlapped by the primary transfer on the intermediate transfer body 74 is secondarily transferred onto the sheet by the secondary transfer roll 88 and the secondary transfer backup roll 182. After the secondary transfer, waste toner remaining on the intermediate transfer body 74 is scraped off by the intermediate transfer body cleaner 92 and collected.

The sheet with a toner image transferred is guided to the fixing device 100, and the toner image is fixed by heat and pressure by the heating roll 102 and the pressurizing roll 104. The sheet with a toner image fixed is ejected onto the eject part 42 from the eject opening 36 by the eject roll 40. The control part 106 stores the life count value, etc., of the toner cartridge 52 in the unit NVM 184 and the main body NVM 228.

Figure 16:
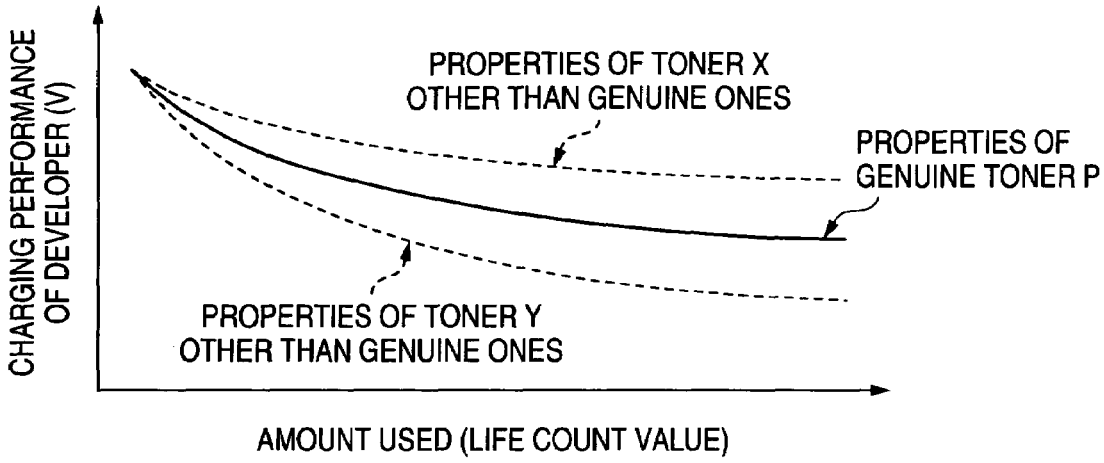
FIG. 16 is a graph showing changes in charging performance of developers with respect to the amounts used (life count value) stored in the main body NVM.

FIG. 16 is a graph showing changes in charging performance of developers with respect to the developer used amounts (life count values) stored in the main body NVM 228.

Figure 17:
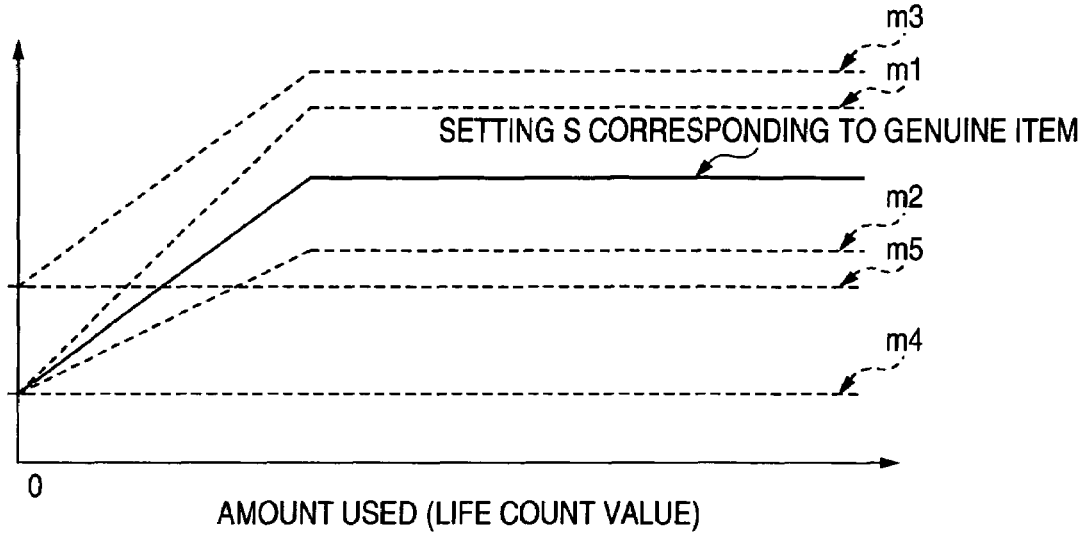
FIG. 17 is a graph showing the settings for correcting the changes in charging performance of the developers, and showing the settings of the image density with respect to the developer used amounts.

FIG. 17 is a graph showing the settings for correcting the changes in charging performance of the developers, and showing the settings of the image density with respect to the developer used amounts.

Figure 18A:
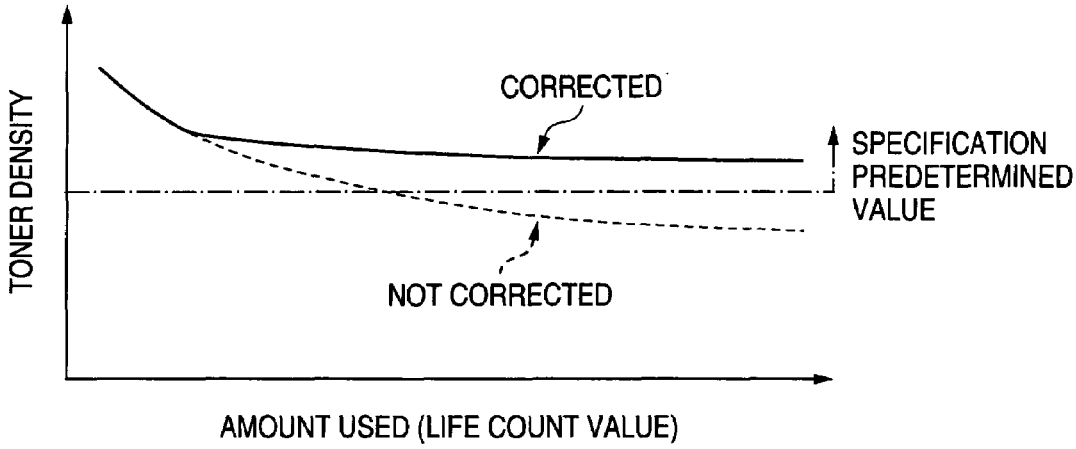
Figure 18B:
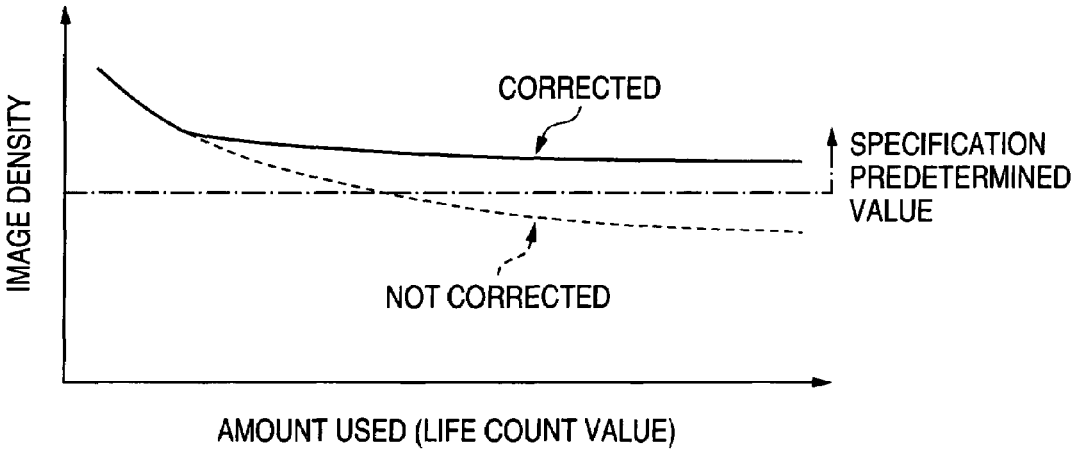

FIGS. 18A and 18B are graphs showing the results of correction according to the settings shown in FIG. 17, wherein FIG. 18A is a graph showing a corrected toner density, and FIG. 18B is a graph showing a corrected image density.

The toner housed in the toner cartridge 52 is frictionally charged to a charge amount with a predetermined polarity by the carrier inside the developing device 48. When the developer is used, like the properties of the toner P that is the genuine item shown in FIG. 16, the charging performance of the developer lowers according to the developer used amount.

Therefore, the image forming apparatus 10 is constructed so that, even when the trickle developing method is employed, to maintain the quality of an image formed on a sheet at a predetermined level, the settings for the toner density inside the developing device 48 and the image density on the intermediate transfer body 74 are corrected.

For example, the CPU 202 detects the image density by the image density sensor 90, and when the density is high, the CPU controls the rotational driving of the first auger 118 to reduce the toner amount to be supplied into the developing device 48 to lower the toner density and lower the image density. On the other hand, when the density is low, the rotational driving of the first auger 118 is controlled to increase the toner amount to be supplied into the developing device 48 to increase the toner density and increase the image density. Normally, as the pattern for image density detection, the pattern with an intermediate tone density is used.

However, when the charging performance of the toner lowers, the developing performance is improved and the image density increases, so that the above-mentioned control is performed without change, the toner density is excessively lowered and the maximum image density is lowered.

Therefore, in order to prevent the maximum image density to be transferred onto the sheet from lowering even when the charging performance of the developer lowers, the set value for toner density control inside the developing device 48 stored in the toner density parameter group 248 to be used for toner density control on the basis of the image density detection results by the image density sensor 90 is corrected to increase according to the used amount of the developer. The CPU 202 maintains the toner density so that the toner density is prevented from becoming lower than a desired predetermined value as shown in FIG. 18A by rotating the first auger 118 according to the corrected set value (FIG. 17: setting S corresponding to the toner P).

As a result, as shown in FIG. 18B, the image density can be maintained so as not to be lower than the predetermined value of the specifications.

On the other hand, when a toner cartridge that is not genuine and houses a toner X or Y other than genuine toners for the image forming apparatus 10, and has almost the same arrangement as that of the toner cartridge 52 is attached, as shown in FIG. 16, it is estimated that properties different from the properties P of the genuine toner are shown. Therefore, in order to improve the quality of an image to be formed on the sheet, a corrected set value different from the setting S corresponding to the toner P is necessary. Therefore, for example, when the toner cartridge is other than genuine cartridges that houses the toner X or the toner Y, correction for the amount to be used for the developer is changed by combining such conditions to be changed that the change amount (inclination) of the toner density set value is increased or decreased (m1, m2: FIG. 17), the limit value is increased or decreased (m1, m2), the initial value (the used amount=0) is changed (m3), the set values according to the used amount are not changed (m4), and for example, the set values according to the use amount are not changed by changing the initial value (m5). This change is performed by selection of an operation mode different from the operation mode corresponding to the genuine item by a user via the UI device 18.

Next, control of the image forming apparatus 10 on the basis of data stored in the storage part 204 and the unit NVM 184 is described.

On the basis of data stored in the storage part 204 and the unit NVM 184, the image forming apparatus 10 displays the toner remaining amount when the toner cartridge 52 is genuine by being controlled by the CPU 202, and displays the toner amount used when the toner cartridge 52 is other than genuine ones. The reason for this is that, since the toner amount is unknown when the toner cartridge is other than genuine cartridges, the toner remaining amount cannot be calculated.

Next, the processing to be executed by the image forming apparatus 10 for printing preparation according to the operation mode is described.

Figure 19:
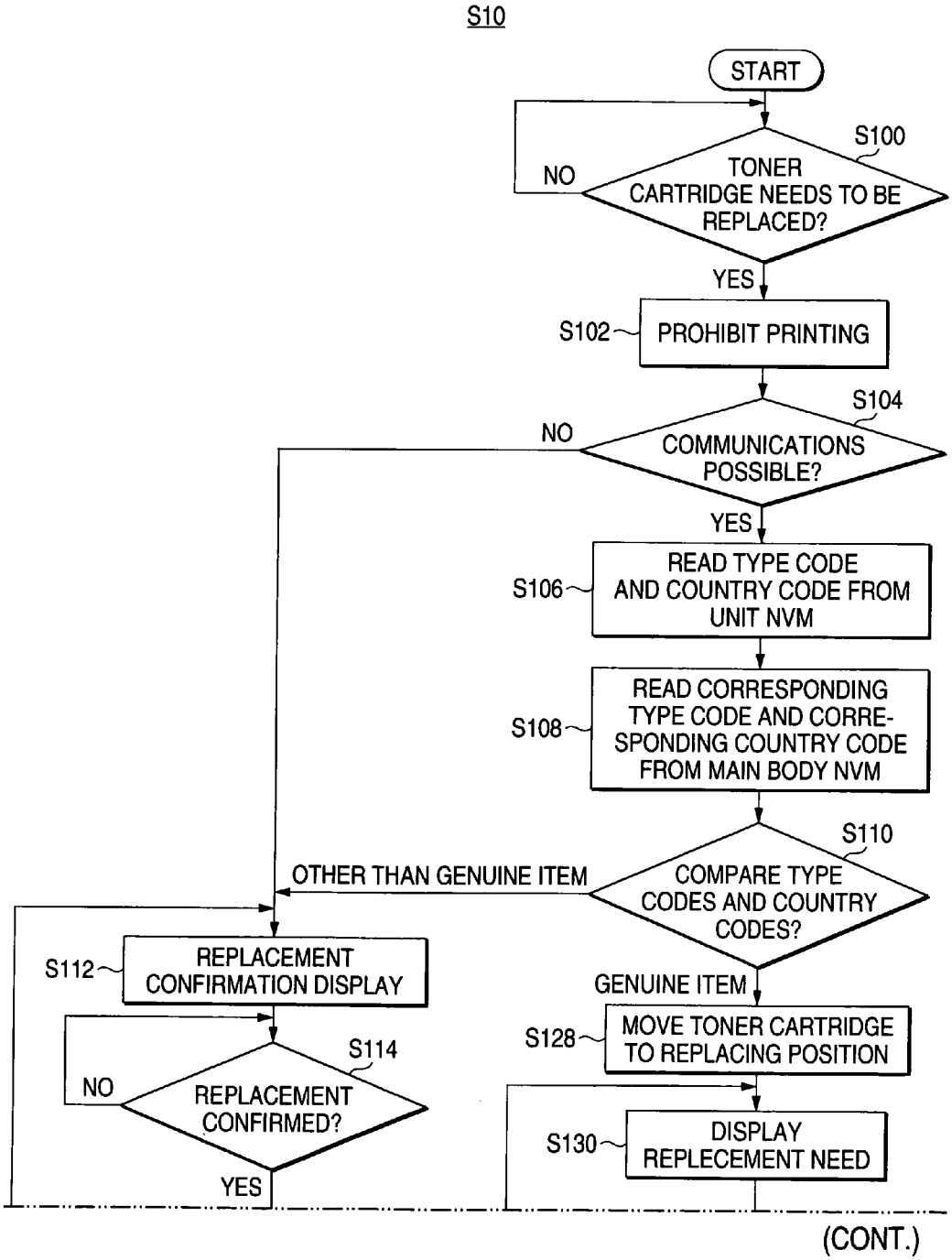
FIG. 19 is a flowchart (S10) showing the processing to be executed by the image forming apparatus for printing preparation suitable for the operation mode with respect to the toner cartridge.

FIG. 19 is a flowchart (S10) showing the processing for the toner cartridge 52, to be executed by the image forming apparatus 10 for printing preparation according to the operation mode.

Figure 20:
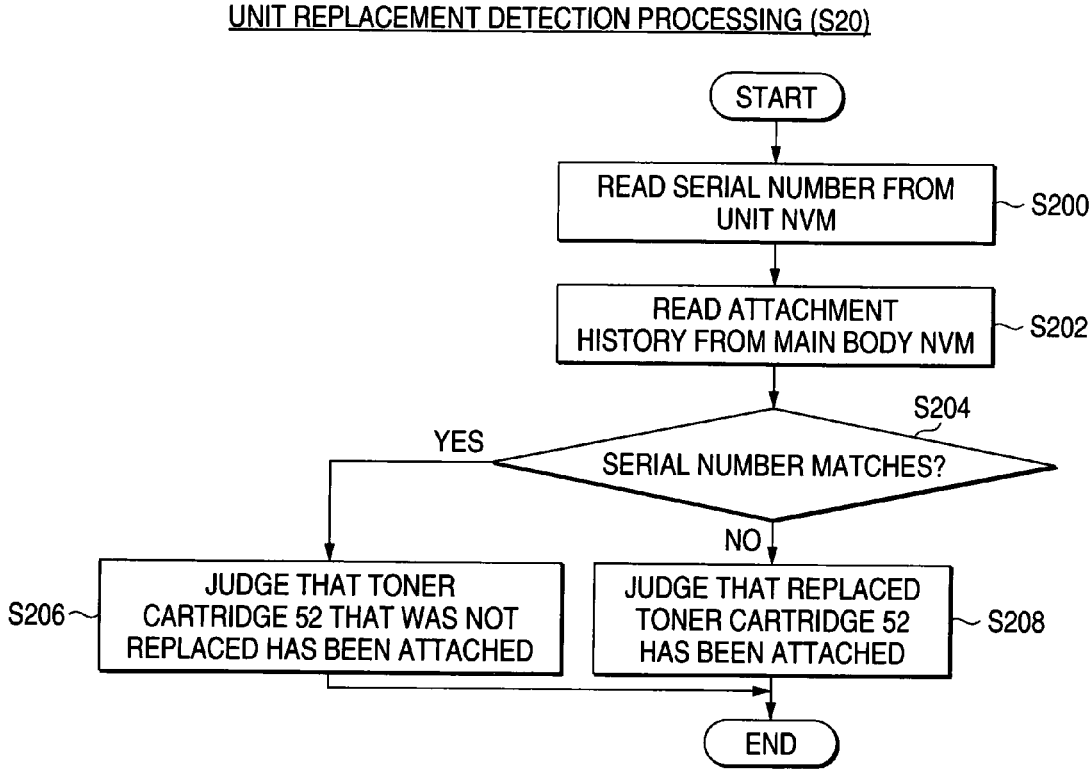
FIG. 20 is a flowchart (S20) showing the unit replacement detection processing for detecting whether or not the toner cartridge has been replaced.

FIG. 20 is a flowchart (S20) showing unit replacement detection processing for detecting whether or not the toner cartridge 52 has been replaced.

Figure 21:
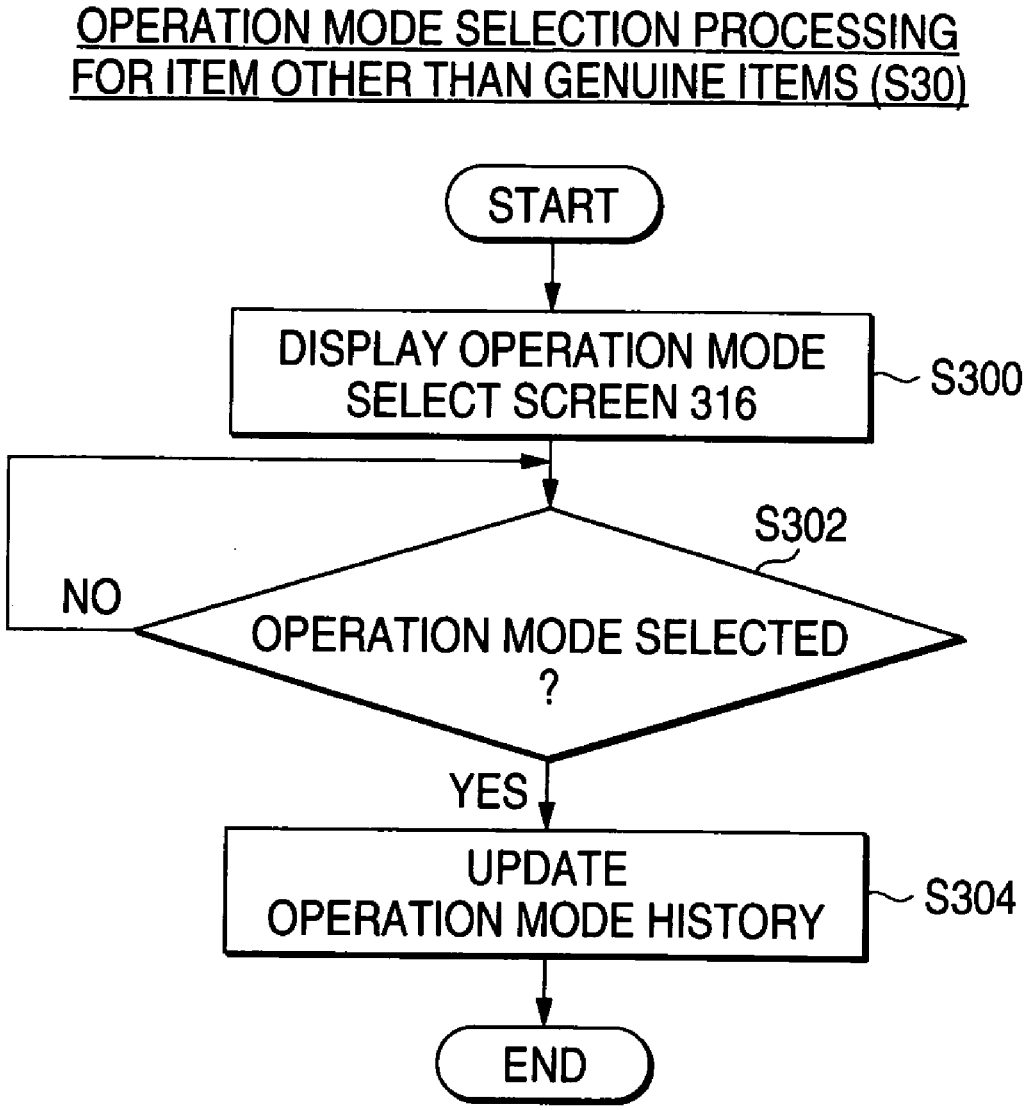
FIG. 21 is a flowchart (S30) showing the operation mode selection processing to be executed by the image forming apparatus for an item other than genuine items in order for a user to select an operation mode for the item other than genuine items.

FIG. 21 is a flowchart (S30) showing operation mode selection processing for an item other than genuine items, to be executed by the image forming apparatus 10 in order for the user to select an operation mode for an item other than genuine items.

Figure 22:
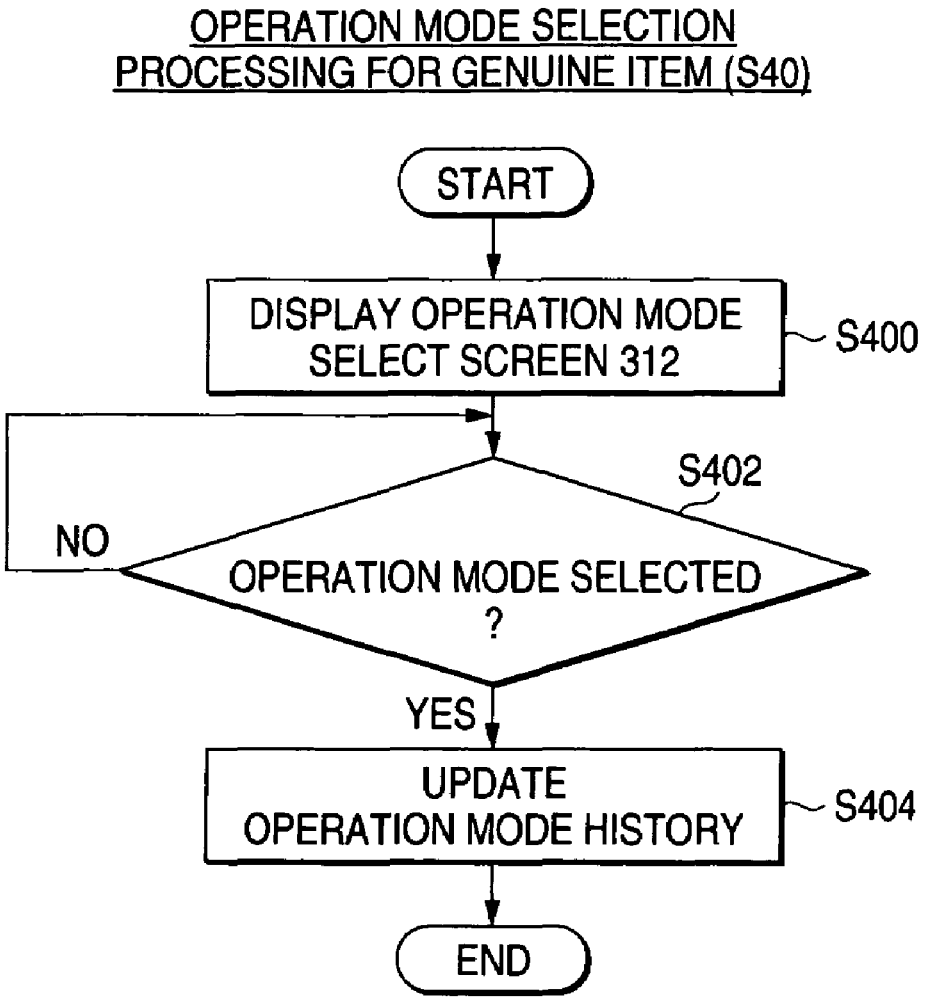
FIG. 22 is a flowchart (S40) showing the operation mode selection processing to be executed by the image forming apparatus for a genuine item in order for a user to select an operation mode for the genuine item.

FIG. 22 is a flowchart (S40) showing operation mode selection processing for a genuine item, to be executed by the image forming apparatus 10 in order for a user to select an operation mode for a genuine item.

Figure 23:
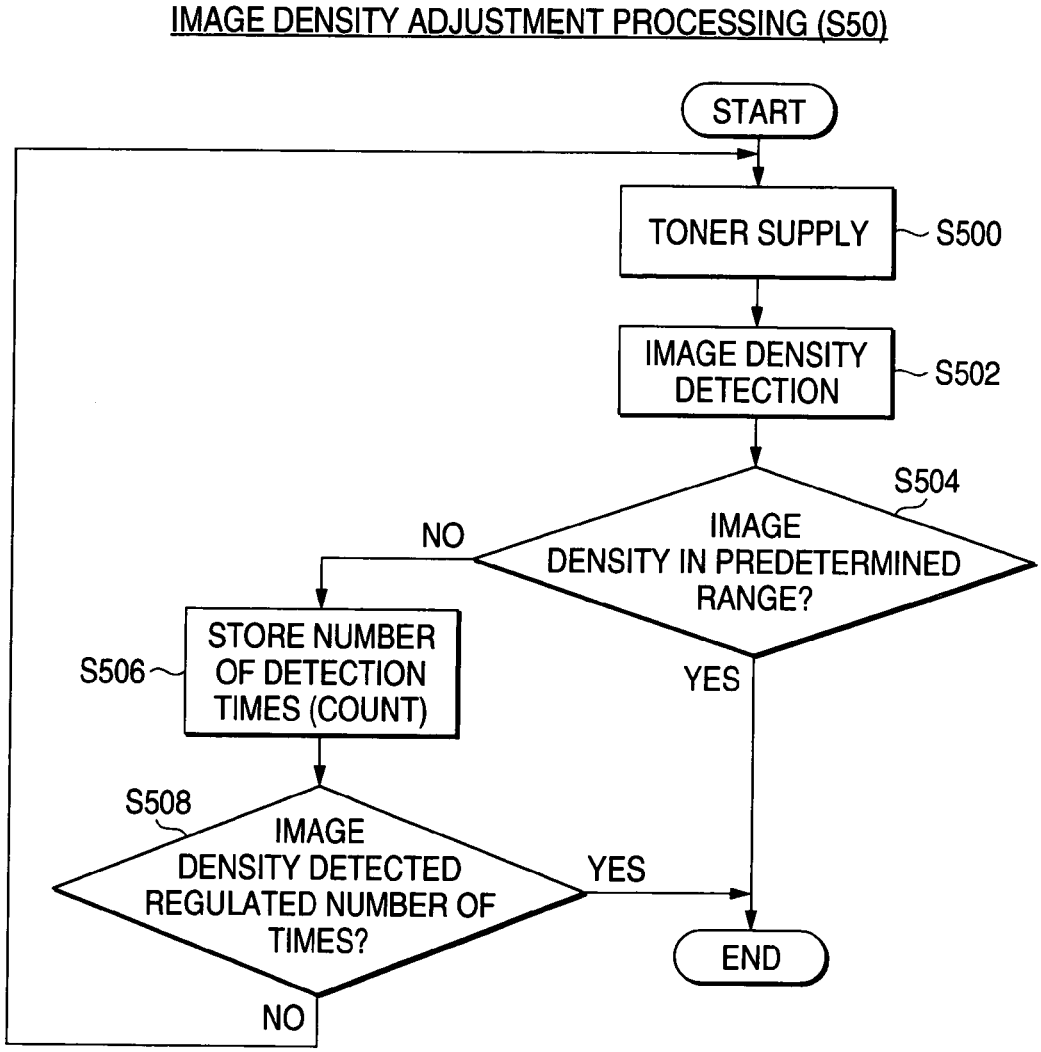
FIG. 23 is a flowchart (S50) showing the processing to be executed by the control part for adjusting the image density.

FIG. 23 is as flowchart (S50) showing processing for adjusting the image density by the control part 106.

As shown in FIG. 19, in Step 100 (S100) the CPU 202 judges whether or not any cartridge of the toner cartridge 52 needs to be replaced. For example, when the density of the image formed on the intermediate transfer body 74 becomes equal to or lower than a predetermined level, the toner density inside the developing device 48 becomes equal to or lower than a predetermined level, or toner exhaustion is detected by the toner existence detection sensor 138, the CPU 202 detects that no toner exists in the toner cartridge 52, and judges that the toner cartridge 52 needs to be replaced. The CPU 202 progresses to the processing of S102 when the toner cartridge 52 needs to be replaced, and when replacement is not necessary, the CPU continues the detection as to whether or not the replacement is necessary until the replacement of the toner cartridge 52 becomes necessary.

In Step 102 (S102), the CPU 202 prohibits printing of the image forming apparatus 10 upon judging that no toner exists in the toner cartridge 52.

In Step 104 (S104), the CPU 202 confirms whether or not signal transmission and receiving (communications) can be made between the same and the memory chips 170 via the wireless communications part 56. When communications are not possible, the CPU 202 judges that the toner cartridge 52 is one other than genuine toner cartridges and progresses to the processing of S112, and when communications are possible, the CPU progresses to the processing of S106.

In Step 106 (S106), the CPU 202 reads the type code 276 and the country code 278 from the unit NVM 184.

In Step 108 (S108), the CPU 202 reads the corresponding type code 258 and the corresponding country code 260 from the main body NVM 228.

In Step 110 (S110), the CPU 202 compares the type code 276 and the corresponding type code 258, compares the country code 278 and the corresponding country code 260, and when the replaced toner cartridge 52 is judged as genuine, the CPU progresses to the processing of S128, and when the replaced toner cartridge 52 is judged as being other than genuine ones, the CPU progresses to the processing of S112.

Figure 24A:
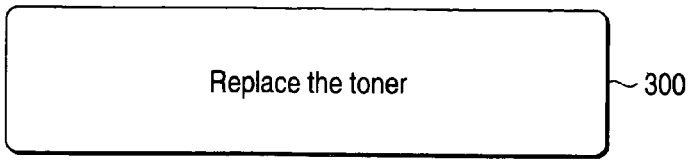
FIGS. 24A to 24D are drawings showing screens to be displayed on the UI device in the processing executed by the image forming apparatus for printing preparation suitable for an operation mode with respect to the toner cartridge.
Figure 24B:
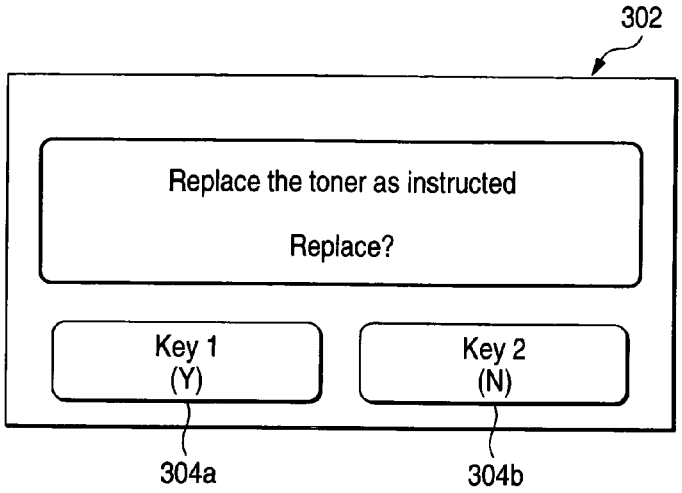

In Step 112 (S112), the UI device 18 displays a replacement confirmation screen 302 shown in FIG. 24B. On the replacement confirmation screen 302, the key button 304*a* accepts that the toner cartridge 52 is to be replaced by a user's input, and the key button 304*b* accepts that the toner cartridge 52 is not to be replaced by a user's input.

In Step 114 (S114), the CPU 202 judges whether or not it has been confirmed that the toner cartridge 52 is to be replaced via the replacement confirmation screen 302. The CPU 202 progresses to the processing of S116 when it is confirmed that the toner cartridge 52 is to be replaced (the key button 304*a* is depressed), and when no confirmation is made, the CPU 202 stands by until replacement of the toner cartridge 52 is confirmed.

In Step 116 (S116), in response to an input into the UI device 18 by a user, the control part 106 rotates the developing device unit 44 to move a toner cartridge 52 that needs to be replaced to a replacing position.

Figure 24C:
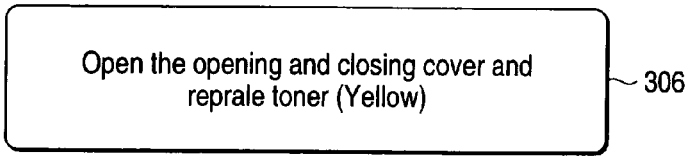

In Step 118 (S118), the UI device 18 displays the replacement instruction screen 306 shown in FIG. 24C.

Figure 24D:
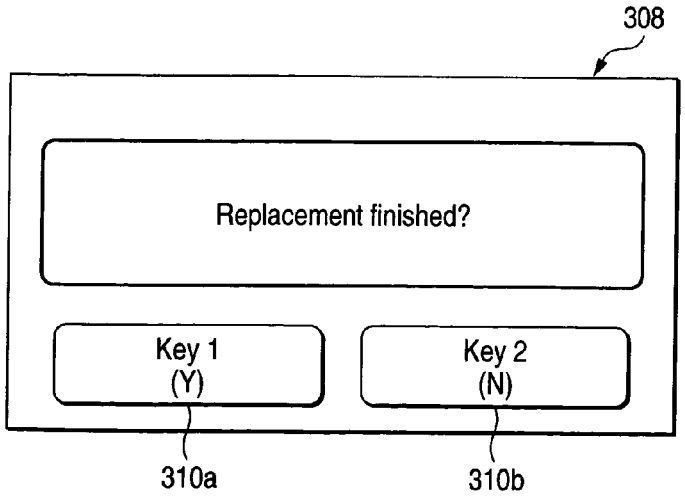

In Step 120 (S120), the UI device 18 displays the replacement finish screen 308 shown in FIG. 24D. On the replacement finish screen 308, the key button 310*a* accepts that the toner cartridge 52 has been replaced in response to a user's input and the key button 310*b* accepts that the toner cartridge 52 has not been replaced in response to a user's input. The replacement instruction screen 306 and the replacement finish screen 308 may be displayed simultaneously.

In Step 122 (S122), the CPU 202 judges whether or not the toner cartridge 52 has been replaced in response to a user's input into the replacement finish screen 308. When it is judged that the toner cartridge 52 has been replaced, the CPU progresses to the processing of S30, and when it is judged that the toner cartridge 52 has not been replaced, the CPU stands by until a user inputs for replacement confirmation. Namely, by the processing from S112 to S122, the CPU 202 judges that the toner cartridge 52 has been replaced.

Figure 25A:
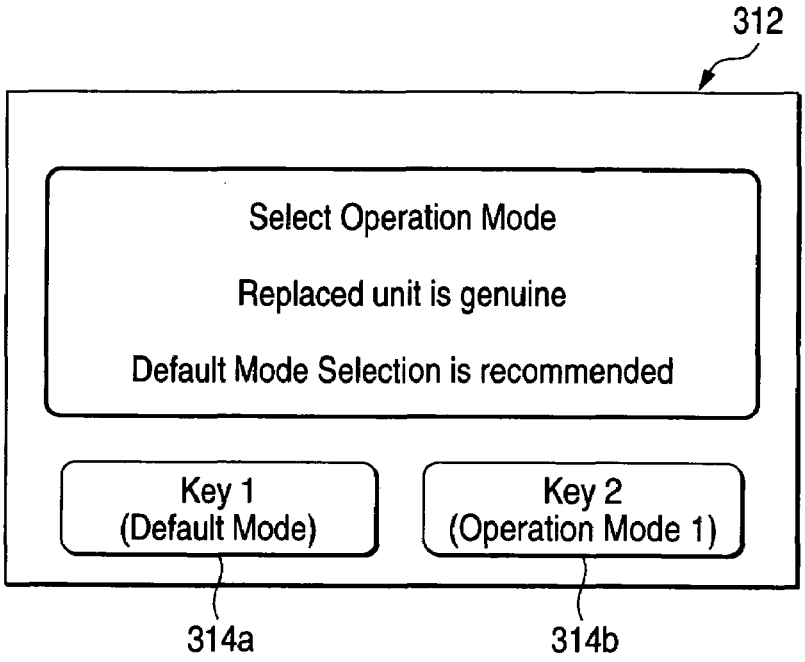
Figure 25B:
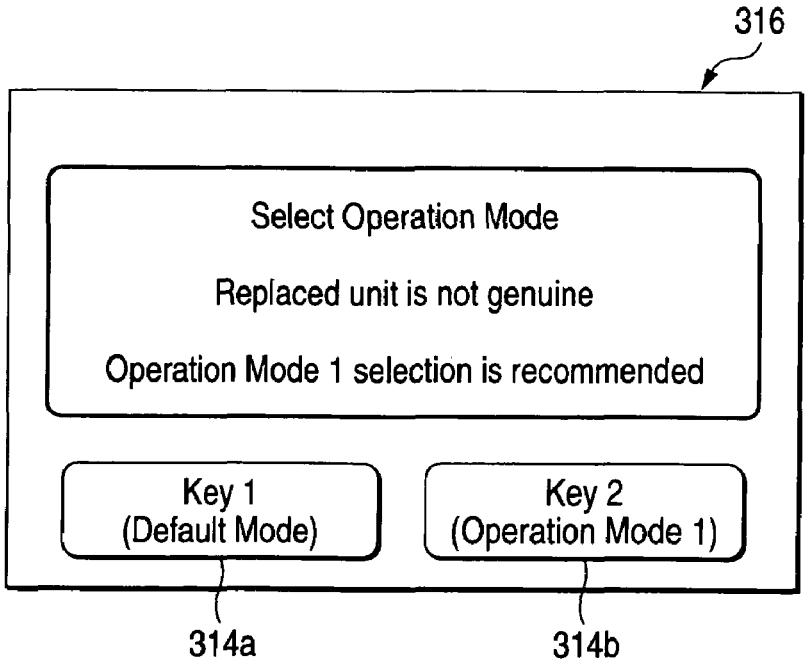

In Step 300 (S300: FIG. 21), the UI device 18 displays the operation mode select screen 316 shown in FIG. 25B.

In Step 302 (S302), the CPU 202 judges whether an input for selecting either the key button 314*a* for selecting a default mode (operation mode corresponding to genuine items) displayed on the operation mode select screen 316 or the key button 314*b* for specifying other operation modes has been made or not. In the case where the input for selecting either the key button 314*a* or the key button 314*b* has been made, the CPU progresses to the processing of S304, and when no input for specifying any operation mode is made, the image forming apparatus 10 stands by until a user selects an operation mode.

In Step 304 (S304), the CPU 202 updates the operation mode histories 270 of the main body NVM 228 to the selected operation mode (including rewriting of identical information)

In Step 500 (S500: FIG. 23), the control part 106 rotates the first auger 118 according to the selected operation mode and supplies toner from the toner cartridge 52 to the developing device 48.

In Step 502 (S502), the CPU 202 detects the image density of a patch formed on the intermediate transfer body 74 via the image density sensor 90.

In Step 504 (S504), the CPU 202 judges whether or not the detected image density is within a predetermined range. When the image density is within a predetermined range, the processing is ended, and when the image density deviates from the predetermined range, the CPU progresses to the processing of S506.

In Step 506 (S506), the CPU 202 stores the number of times (count) of detecting the image density in, for example, the RAM 226 or the like.

In Step 508 (S508), the CPU 202 judges whether or not the number of times of detecting the image density has reached a regulated number, and when the regulated number of times is reached, the processing is ended, and when the regulated number of times is not reached, the CPU progresses to the processing of S500.

In Step 124 (S124: FIG. 19), the CPU 202 judges whether or not the image density adjustment by the image density adjustment processing (S50) has been normally finished. For example, as in the case where the image density is within the predetermined range, when the image density adjustment is normally finished, the CPU progresses to the processing of S126, and when the image density adjustment is not normally finished, the CPU progresses to the processing of S112.

In Step 126 (S126), the CPU 202 resets (initializes) the life count value stored in the life count values 264 of the main body side so as to correspond to the replaced toner cartridge 52.

In Step 128 (S128), in response to a user's input into the UI device 18, the control part 106 rotates the developing device unit 44 to move a toner cartridge 52 that needs to be replaced to a replacing position.

In Step 130 (S130), the UI device 18 displays the replacement need display screen 300 shown in FIG. 24A.

In Step 132 (S132), the CPU 202 detects whether or not the opening and closing cover 16 has been opened or closed via the opening and closing detection sensor 19, and when it is judged that the opening and closing cover 16 has been opened or closed, the CPU 202 progresses to the processing of S20, and when opening or closing of the opening and closing cover 16 is not detected, the CPU progresses to the processing of S130.

In Step 200 (S200: FIG. 20), the CPU 202 reads the serial number 280 from the unit NVM 184.

In Step 202 (S202), the CPU 202 reads the serial number of the toner cartridge that had been attached last, included in the unit attachment histories 262 of the main body NVM 228.

In Step 204 (S204), the CPU 202 judges whether or not the serial number of the toner cartridge that had been attached last is identical to the serial number 280 read from the unit NVM 184. When the serial number of the toner cartridge that had been attached last is identical to the serial number 280 read from the unit NVM 184, the CPU progresses to the processing of S206, and otherwise it progresses to the processing of S208.

In Step 206 (S206), the CPU 202 judges that the toner cartridge 52 that was not replaced has been attached again (has not been replaced).

In Step 208 (S208), the CPU 202 judges that a replaced toner cartridge 52 has been attached (replacement has been detected).

In Step 134 (S134: FIG. 19), the CPU 202 progresses to the processing of S40 when it judges that replacement of the toner cartridge 52 has been detected by the unit replacement detection processing (S20), and otherwise the CPU progresses to the processing of S130.

In Step 400 (S400: FIG. 22), the UI device 18 displays the operation mode select screen 312 shown in FIG. 25A.

In Step 402 (S402), the CPU 202 judges whether an input for selecting either the key button 314*a* for selecting the default mode (operation mode corresponding to genuine items) displayed on the operation mode select screen 312 or the key button 314*b* for specifying other operation modes has been made or not. When the input for selecting either the key button 314*a* or 314*b* is made, the CPU progresses to the processing of S404, and when no input for specifying any of operation modes is made, the image forming apparatus 10 stands by until a user selects an operation mode.

In Step 404 (S404), the CPU 202 updates the operation mode histories 270 of the main body NVM 228 to the operation mode selected in S402 (including rewriting of identical information).

In Step 136 (S136: FIG. 19), the CPU 202 performs printing preparation corresponding to the selected operation mode included in the latest operation mode histories 270, and then ends the processing. In the printing preparation of S136, for example, it can be displayed on the UI device 18 which of a genuine item or one other than genuine items the toner cartridge 52 being attached is.

Furthermore, it is also possible that a plurality of other operation modes different from the operation mode corresponding to genuine items are provided, and a user can freely select an operation mode among the plurality of other operation modes.

Thus, even when a replaceable unit of the image forming apparatus 10 is one other than genuine units, the image quality can be improved by selecting an operation mode different from the operation mode corresponding to genuine items by a user.

Furthermore, when all replaceable units are genuine, it is also possible that the operation modes that are selectable by a user are limited so that the image forming apparatus 10 operates only in the operation modes corresponding to the genuine items, whereby the image quality is prevented from being erroneously lowered by a user.

Next, a first modification of processing to be executed by the image forming apparatus 10 for printing preparation suitable for the operation mode is described.

Figure 26:
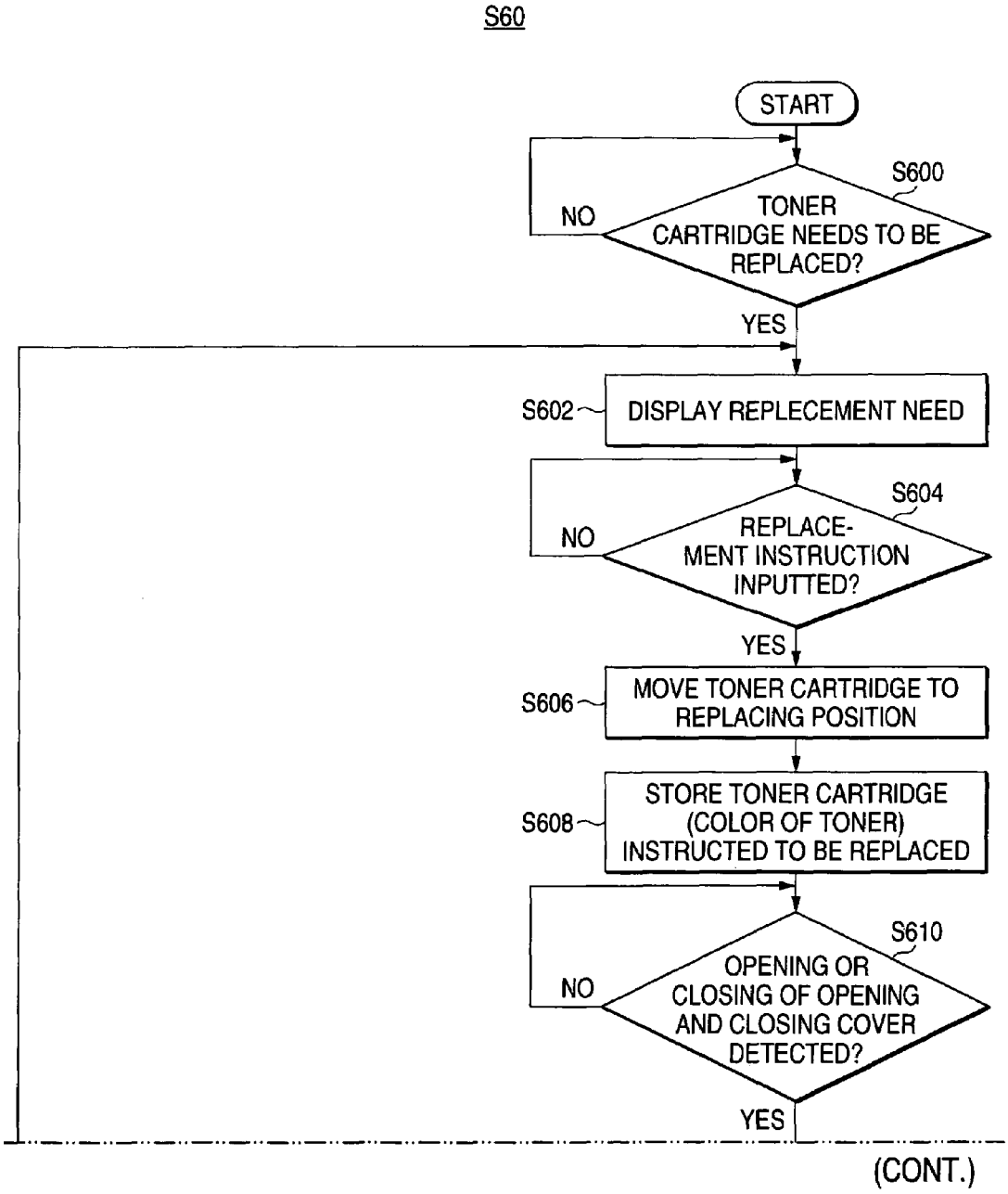
FIG. 26 is a flow chart (S60) showing the first modification of the processing to be executed by the image forming apparatus for printing preparation suitable for an operation mode with respect to the toner cartridge.

FIG. 26 is a flowchart (S60) showing a first modification of the processing to be executed by the image forming apparatus 10 for printing preparation suitable for the operation mode with respect to the toner cartridge 52.

As shown in FIG. 26, in Step 600 (S600), the CPU 202 judges whether or not any cartridge of the toner cartridge 52 needs to be replaced. The CPU 202 progresses to the processing of S602 when replacement of the toner cartridge 52 is necessary, and otherwise the CPU continues detection as to whether or not replacement is necessary until replacement of the toner cartridge 52 becomes necessary.

In Step 602 (S602), the UI device 18 displays the replacement need display screen 300 shown in FIG. 24A.

In Step 604 (S604), the CPU 202 judges whether or not an input for instructing replacement of the toner cartridge 52 has been made by a user, and when it is instructed, the CPU progresses to the processing of S606, and otherwise the CPU stands by until an instruction is given.

In Step 606 (S606), in response to a user's input into the UI device 18, the control part 106 rotates the developing device unit 44 to move the toner cartridge 52 that needs to be replaced to a replacing position.

In Step 608 (S608), the CPU 202 sets a flag or the like indicating any cartridge of the toner cartridge 52, instructed to be replaced, in, for example, the RAM 226, and the toner cartridge 52 that needs to be replaced (or toner color) is stored.

In Step 610 (S610), the CPU 202 detects whether or not the opening and closing cover 16 has been opened or closed via the opening and closing detection sensor 19, and progresses to the processing of S612 when the opening or closing of the opening and closing cover 16 has been detected, and when the opening or closing of the opening or closing cover 16 has not been detected, the CPU stands by until the opening or closing of the opening and closing cover 16 is detected. CPU 202 judges that the toner cartridge 52 has been replaced on the basis of the fact that an input for instructing replacement of the toner cartridge 52 has been made and opening and closing of the opening and closing cover 16 have been made. Namely, by the processing from S604 to S610, the CPU 202 judges that the toner cartridge 52 has been replaced.

In Step 612 (S612, the CPU 202 confirms whether or not transmission and receiving (communications) of signals are possible between the same and the memory chips l70 via the wireless communications part 56. When communications are not possible, the CPU 202 judges that the toner cartridge 52 is other than genuine items and progresses to the processing of S30, and progresses to the processing of S614 when communications are possible.

In Step 614 (S614), the CPU 202 reads the type code 276 and the country code 278 from the unit NVM 184.

In Step 616 (S616), the CPU 202 reads the corresponding type code 258 and the corresponding country code 260 from the main body NVM 228.

In Step 618 (S618), the CPU 202 compares the type code 276 and the corresponding type code 258, compares the country code 278 and the corresponding country code 260, and when it is judged that the replaced toner cartridge 52 is genuine, the CPU progresses to the processing of S40 (see FIG. 22), and progresses to the processing of S30 (see FIG. 21) and S50 (see FIG. 23) in order when the replaced toner cartridge 52 is other than genuine items.

In Step 620 (S620), the CPU 202 judges whether or not the image density adjustment by the image density adjustment processing (S50) has been normally finished. For example, as in the case where the image density is within the predetermined range, when the image density adjustment is normally finished, the CPU progresses to the processing of S622, and progresses to the processing of S602 when the image density adjustment is not normally finished.

In Step 622 (S622), the CPU 202 resets (initializes) the life count value stored in the life count values 264 of the main body side so as to correspond to the replaced toner cartridge 52.

In Step 624 (S624), the CPU 202 performs printing preparation suitable for the selected operation mode included in the latest operation mode histories 270 and ends the processing.

Next, a second modification of the processing to be executed by the image forming apparatus 10 for printing preparation suitable for an operation mode is described.

Figure 27:
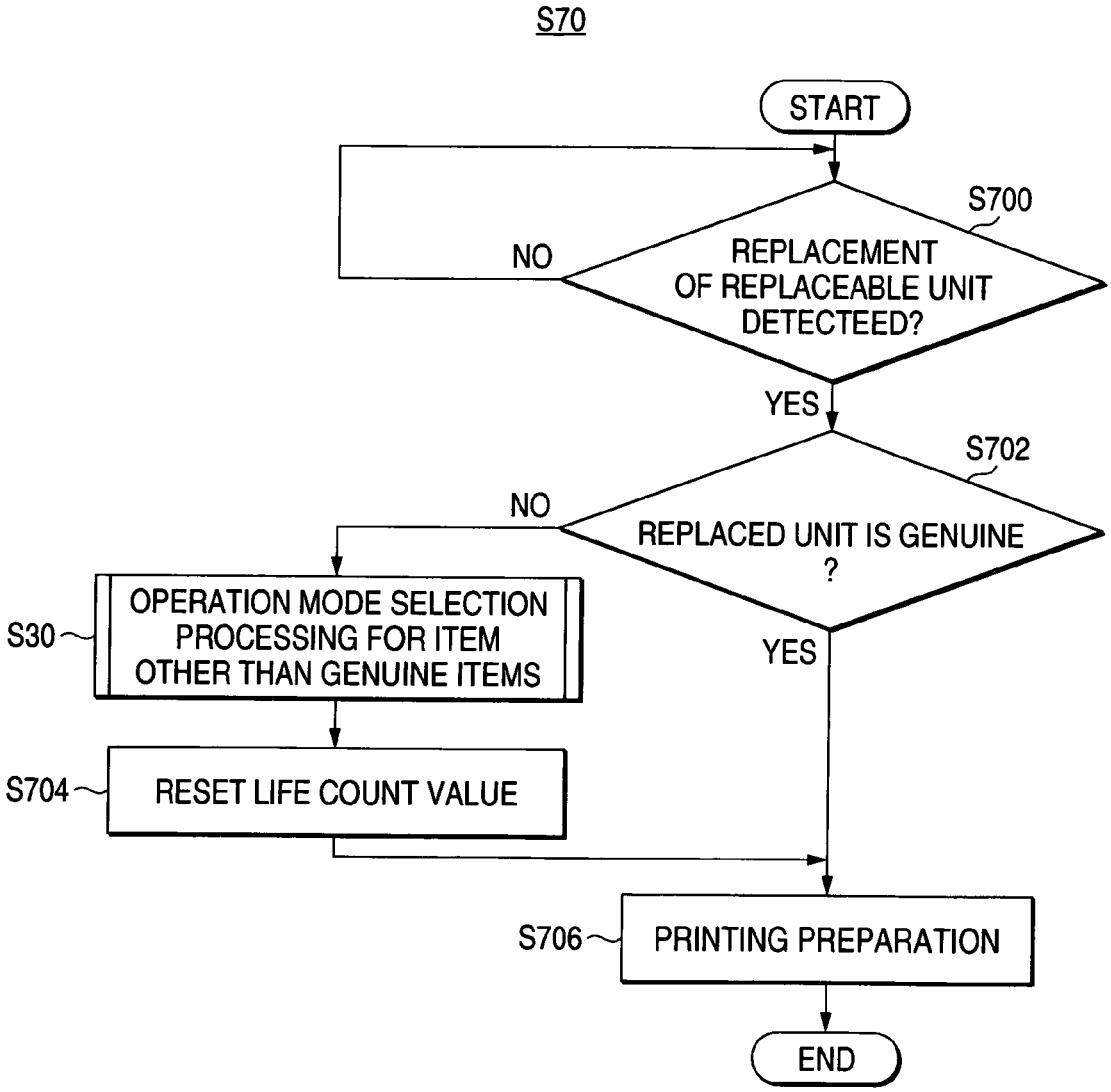
FIG. 27 is a flowchart (S70) showing the second modification of the processing to be executed by the image forming apparatus for printing preparation suitable for an operation mode with respect to a replaceable unit such as the toner cartridge.

FIG. 27 is a flowchart (S70) showing the second modification of the processing to be executed by the image forming apparatus 10 for printing preparation suitable for an operation mode with respect to a replaceable unit such as the toner cartridge 52.

As shown in FIG. 27, in Step 700 (S700), the CPU 202 detects whether or not a replaceable unit such as the toner cartridge 52 has been replaced on the basis of, for example, recovering of the image density (described later with reference to FIG. 28) with respect to the amount used for the toner cartridge 52, and progresses to the processing of S702 in the case where the replaceable unit has been replaced, and in the case where the replaceable unit has not been replaced, the CPU continues the detection as to whether or not the replaceable unit has been replaced until replacement of the replaceable unit is detected.

In Step 702 (S702), concerning, for example, a replaceable unit, the CPU 202 compares the information stored in the main body NVM 228 and the information stored in the unit NVM 184 to detect whether or not the replaceable unit is genuine. The CPU 202 progresses to the processing of S706 when the replaceable unit is genuine, and progresses to the processing of S30 (see FIG. 21) when the replaceable unit is other than genuine items.

In Step 704 (S704), the CPU 202 resets (initializes) the life count value stored in the life count values 264 of the main body side so as to correspond to the replaced replaceable unit.

In Step 706 (S706), the CPU 202 performs printing preparation suitable for the selected operation mode included in the latest operation mode histories 270 (the default operation mode or the selected operation mode), and ends the processing.

Next, another method for judging whether or not a replaceable unit has been replaced is described.

Figure 28:
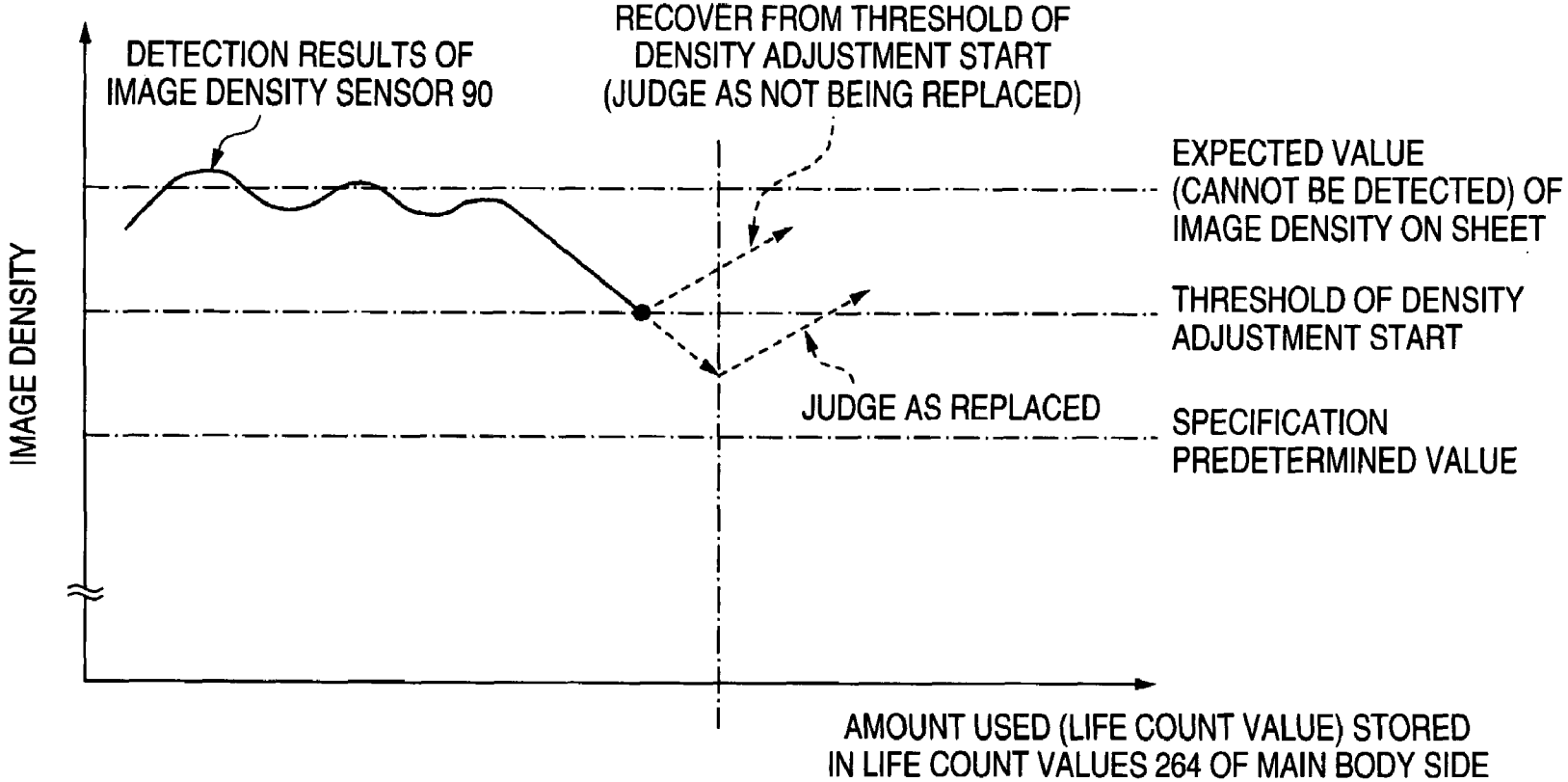
FIG. 28 is a graph showing a criterion for judging whether or not the toner cartridge has been replaced on the basis of an image density change.

FIG. 28 is a graph showing a criterion for judging whether or not the toner cartridge 52 has been replaced on the basis of an image density change. When the toner cartridge 52 is used, the amount used for the toner cartridge 52 is stored in the life count values 264 of the main body side. When the amount used for the toner cartridge 52 increases, the density of an image formed on the intermediate transfer body 74 gradually lowers with respect to an expected value of the density of an image to be formed on a sheet. When the CPU 202 judges that the density of the image on the intermediate transfer body 74 has lowered to the threshold of density adjustment start via the image density sensor 90, the CPU supplies toner to the developing device 48 by rotating the first auger 118 and makes controlling to increase the image density. When the image density detected by the image density sensor 90 changes to increase (recover) from the threshold of image density adjustment start, the CPU 202 judges that the toner cartridge 52 houses toner and is being used.

On the other hand, by use of the toner cartridge 52, when the image density detected by the image density sensor 90 continues to lower from the threshold of image density adjustment start, the CPU 202 judges that the toner inside the toner cartridge 52 is decreasing and is becoming unable to satisfy the specification predetermined value. Furthermore, when the image density detected by the image density sensor 90 changes to increase (recover) from the value lower than the threshold of image density adjustment start, the CPU 202 judges that the toner cartridge 52 has been replaced.

It is also possible that CPU 202 judges that the toner cartridge 52 has been replaced on the basis of the fact that the toner density change detected by the toner density sensor 142 changes to increase (recover) from the value lower than the threshold of the toner density adjustment start.

Furthermore, it is also possible that, after it is detected by the toner existence detection sensor 138 that no toner exists in the taking-in conveyance path 128, when the toner existence detection sensor 138 detects that toner exists again, the CPU 202 judges that the toner cartridge 52 has been replaced.

It is also possible that, the results of detection by the non-use detection sensor 70 as to whether or not the toner cartridge 52 is unused change, the CPU 202 judges that the toner cartridge 52 has been replaced.

Furthermore, it is also possible that, when it is judged by the waste toner full sensor 198 that the waste toner collecting bottle 66 is full before the CPU 202 judges that the toner cartridge 52 has been replaced on the basis of the above-mentioned criteria, the CPU 202 judges that any cartridge of the toner cartridge 52, for example, the toner cartridge 52 the amount used of which is largest has been replaced. Furthermore, it is also possible that the waste toner full sensor 198 is provided on the intermediate transfer body cleaner 92, and when it is detected that the waste toner collecting bottle 98 is full, the CPU 202 judges that any cartridge of the toner cartridge 52 such as the toner cartridge 52 the amount used of which is largest has been replaced.

Furthermore, it is also possible that the CPU 202 judges that the replaceable unit has been replaced by combining the turning on and off of the power supply of the image forming apparatus 10 with user's other operations.

Namely, in S700 of the second modification (S70) of the processing to be executed by the image forming apparatus 10 for printing preparation suitable for the operation mode, it may be judged whether or not a replaceable unit such as the toner cartridge 52 has been replaced on the basis of the results of detection of the image density sensor 90, the results of detection of the toner density sensor 142, the results of detection of the toner existence detection sensor 138, the results of detection of the non-use detection sensor 70, and the results of detection of the waste toner full sensor 198.

Furthermore, it is also possible that memory chips 170 are provided on replaceable units other than the toner cartridge 52 and the CPU 202 acquires information on the replaceable units.

What is claimed is:

1. An image forming apparatus comprising:

an apparatus main body;

at least one replaceable unit attached in a replaceable manner to this apparatus main body;

a storage unit which is provided in the apparatus main body and stores information on an amount used for a replaceable unit;

a control unit for controlling on the basis of the information on the amount used for the replaceable unit stored in the storage unit;

a first judging unit for judging whether the replaceable unit is genuine or other than genuine units;

a second judging unit for judging whether or not the replaceable unit has been replaced; and an initialization unit for initializing the information on the amount used for the replaceable unit stored in the storage unit when it is judged that the replaceable unit has been replaced with one other than genuine units from the results of judgment of the first judging unit and the second judging unit.

2. The image forming apparatus according to claim 1, further comprising:

a communications unit which is provided on the apparatus main body side and makes communications so as to acquire information from the replaceable unit, wherein the first judging unit judges whether the replaceable unit is genuine or other than genuine units from the results of communications of the communication unit.

3. The image forming apparatus according to claim 2, wherein the first judging unit judges the replaceable unit as being other than genuine units when no information can be acquired from the replaceable unit as a result of communications of the communications unit.

4. The image forming apparatus according to claim 1, further comprising:

a display unit for displaying information on an amount used for a replaceable unit, wherein the control unit controls the display unit.

5. The image forming apparatus according to claim 1, wherein the control unit performs controlling so as to correct image forming conditions according to the amount used for a replaceable unit.

6. The image forming apparatus according to claim 1, wherein the second judging unit judges whether or not the replaceable unit has been replaced from information on a replacement operation for the replaceable unit.

7. The image forming apparatus according to claim 1, further comprising:

an image carrier for carrying a developer image; and an image density change detection unit for detecting a change in density of a developer image carried by this image carrier, wherein the second judging unit judges whether or not the replaceable unit has been replaced on the basis of the results of detection of the image density change detection unit.

8. The image forming apparatus according to claim 1, further comprising:

an image carrier for carrying an image by carrying a developer; and a developer amount detection unit for detecting information on an amount used for a developer carried by the image carrier, wherein the second judging unit judges whether or not the replaceable unit has been replaced on the basis of the results of detection of the developer amount detection unit.

9. The image forming apparatus according to claim 1, further comprising:

a use history judging unit for judging use history of the replaceable unit, wherein the second judging unit judges whether or not the replaceable unit has been replaced on the basis of the results of judgment of the use history judging unit.

10. The image forming apparatus according to claim 1, further comprising:

an image carrier for carrying an electrostatic latent image and a developer image;

a developer collecting unit for collecting a developer remaining on the image carrier after the image carrier transfers the developer image; and a collected developer amount detection unit for detecting the amount of the developer collected by the developer collecting unit, wherein the second judging unit judges whether or not the replaceable unit has been replaced on the basis of the results of detection of the collected developer amount detection unit.

11. The image forming apparatus according to claim 10, further comprising:

a developing unit for developing an electrostatic latent image carried by the image carrier; and a transfer unit for transferring the developer image carried by the image carrier, wherein the replaceable unit is formed integrally with at least any of the image carrier, the developer collecting unit, the developing unit, and the transfer unit.

12. The image forming apparatus according to claim 1, further comprising:

an image carrier for carrying an electrostatic latent image and a developer image;

an intermediate transfer body for carrying a developer image transferred from the image carrier;

an intermediate transfer body developer collecting unit for collecting a developer remaining on the intermediate transfer body after the intermediate transfer body transfers a developer image; and an intermediate transfer body collected developer amount detection unit for detecting an amount of developer collected by the intermediate transfer body developer collecting unit, wherein the second judging unit judges whether or not the replaceable unit has been replaced on the basis of the results of detection of the intermediate transfer body collected developer amount detection unit.

13. The image forming apparatus according to claim 12, further comprising:

a developing unit for developing an electrostatic latent image carried by the image carrier;

a first transfer unit for transferring a developer image carried by the image carrier onto the intermediate transfer body;

a developer collecting unit for collecting a developer remaining on the image carrier after transferring the developer image carried by the image carrier; and a second transfer unit for transferring the developer image carried by the intermediate transfer body, wherein the replaceable unit is formed integrally with at least any of the image carrier, the developing unit, the first transfer unit, the developer collecting unit, the intermediate transfer body, the second transfer unit, and the intermediate transfer body developer collecting unit.

14. The image forming apparatus according to claim 4, wherein the display unit displays information on the amount used for the replaceable unit on the basis of information on the amount used for the replaceable unit initialized by the initialization unit.

15. The image forming apparatus according to claim 5, wherein the control unit corrects image forming conditions on the basis of information on the amount used for the replaceable unit initialized by the initialization unit.

16. The image forming apparatus according to claim 1, further comprising:

a judging result display unit for displaying the results of judgment of the first judging unit and the second judging unit when it is judged that the replaceable unit has been replaced with a unit other than genuine units from the results of judgment of the first judging unit and the second judging unit; and an input unit for selecting an operation mode corresponding to a genuine replaceable unit and another operation mode different from said operation mode, wherein the input unit receives an input for selecting the operation mode corresponding to a genuine replaceable unit and another mode different from said operation mode after the judging result display unit displays the results of judgment.

* * * * *